United States Patent [19]

Weilgart

[11] Patent Number: 4,813,710

[45] Date of Patent: Mar. 21, 1989

[54] DICTIONARY INDEX

[76] Inventor: Alexander W. Weilgart, 2337 Harrison St., Oakland, Calif. 94612

[21] Appl. No.: 925,993

[22] Filed: Nov. 3, 1986

[51] Int. Cl.[4] ..... B42D 15/00

[52] U.S. Cl. ..... 283/40; 283/36; 283/37; 283/38

[58] Field of Search ..... 283/36, 37, 38, 39, 283/40, 41, 42, 43

[56] References Cited

U.S. PATENT DOCUMENTS

| | | | |
|---|---|---|---|
| 154,768 | 9/1874 | Sargent | 283/40 |
| 356,334 | 1/1887 | Rosewater | 283/40 |
| 371,791 | 10/1887 | Rosewater | 283/40 |
| 404,294 | 5/1889 | Lester | 283/39 |
| 500,262 | 6/1893 | Dean | 283/40 |
| 533,811 | 2/1895 | Hon | 283/40 |
| 535,351 | 3/1895 | Brashear | 283/37 |
| 587,084 | 7/1897 | Wilson | 283/37 |
| 595,194 | 12/1897 | Neuner | 283/37 |
| 629,214 | 7/1899 | Simpson | 283/40 |
| 669,554 | 3/1901 | Shepherd | 283/37 |
| 757,510 | 4/1904 | Shepherd | 283/37 |
| 787,111 | 4/1905 | Pohl | 283/39 |
| 856,861 | 6/1907 | Gloe | 283/37 |
| 882,816 | 3/1908 | Dean | 283/40 |
| 1,026,804 | 5/1912 | Hare | 283/40 |
| 1,061,790 | 5/1913 | Webb | 283/40 |
| 1,132,222 | 3/1915 | Smith | 283/40 |
| 1,305,939 | 6/1919 | Schmidt | 283/36 |
| 2,259,203 | 10/1941 | Fleming, Jr. | 283/40 |
| 2,288,066 | 6/1941 | Bloom | 283/40 |
| 2,680,630 | 6/1954 | Machol | 283/38 |
| 4,291,900 | 9/1981 | Feng | 283/38 X |

FOREIGN PATENT DOCUMENTS

| | | | |
|---|---|---|---|
| 957976 | 3/1950 | France | 283/42 |
| 1085284 | 1/1955 | France | 283/42 |
| 77119 | 8/1918 | Switzerland | 283/39 |

*Primary Examiner*—Paul A. Bell

[57] ABSTRACT

An improved dictionary index that allows a person to open a dictionary often just a few pages from where his word is located. Given the word "ran," r, a, and n are #1, #2, and #3 letters respectively. This index allows a person to open to where the #2 letter begins, and if set up for it, in many cases to open to where the #3 letter begins, so that in this case the person is shown where to open the dictionary to have "ran" on that open page. This is accomplished partly by subdividing the words beginning with #1 letters into lesser categories—26 if each of the letters is to be presented as a #2 letter, and perhaps 40 or more if some #2 letters are further subdivided into #3 letters—for instance such #2 letters as A, E, I, O, U, H, L, N, R. A chart of these perhaps 40 letters is placed for instance on the inside back book cover where the cover extends past the pages. Within the successive pages in the dictionary that are provided for the words of each #1 letter (presuming for the moment that each of the 26 #1 letters' pages are to be dealt with), on the page of any particular #1 letter where each of these 40 categories is earliest found, a mark is printed on that page edge directly across from the category on the chart. The first of these 40 marks, being that they are arranged alphabetically, begins on an earlier page in the dictionary at the top of the dictionary. The last of these 40 marks is at the bottom of the dictionary some pages back at the end of this particular #1 letter, with the in-between 38 other marks arranged between, so that there appears to be a "diagonal line" of marks reaching across the page edges of this particular #1 letter. In same manner make a diagonal line of marks for the pages of each of the other 25 #1 letters. Herein the same categories on the chart are used for each of the #1 letters, so that finally there are 26 separate diagonal lines, and across from each category there are a total of twenty-six marks. With such a manufactured dictionary index, by a person locating his #1 letter's diagonal line and finding his #2 and possibly #3 letter on the chart, he can quickly find where in the dictionary his #2 and possibly #3 letters are located by reaching to the mark across from his category on his #1 letter's diagonal line and opening the dictionary to that point.

47 Claims, 6 Drawing Sheets

FIG. 7 PAGES #2 LETTERS

| | | | | | | | | |
|---|---|---|---|---|---|---|---|---|
| A 246.3 | B 9.6 | C 25.3 | D 9.75 | E 209.6 | F 5.6 | G 4.8 | H 63.5 | I 144.8 |
| J .5 | K 3.25 | L 68.4 | M 20.4 | N 70.25 | O 211.1 | P 29.3 | Q 3.75 | R 124.7 |
| S 17.1 | T 35.8 | U 104.3 | V 8.1 | W 8 | X 2.8 | Y 25.5 | Z 1 | |

FIG. 8 HOW MANY #3 LETTERS

| A | E | H | I | L | N | O | R | U |
|---|---|---|---|---|---|---|---|---|
| 6 | 5 | 2 | 4 or 3 | 2 | 2 | 5 | 3 | 3 or 2 |
| 5 | 4 | 1 | 3 | 1 or 2 | 1 or 2 | 4 | 3 or 2 | 2 |
| 4 | 3 or 4 | 1 | 2 | 1 | 1 | 3 | 2 | 2 |
| 3 | 3 or 2 | 1 | 2 | 1 | 1 | 3 or 2 | 2 or 1 | 1 |
| 2 | 2 | 1 or 0 | 1 | 1 or 0 | 1 or 0 | 2 | 1 | 1 |
| 1 | 1 | 0 | 1 | 0 | 0 | 1 | 1 or 0 | 1 or 0 |

FIG. 9 SPECIFIC #3 LETTERS

| | 1 | 2 | 3 | 4 | 5 | 6 |
|---|---|---|---|---|---|---|
| A | n | lr | imr | glns | flnrs | dilnrs |
| E | morn | lr | emr | dlnr | dinrs | |
| I | rorn | lr | gnr | elns | | |
| O | n | mr | lot | lnru | hmnrt | |
| U | n | lr | lnr | | | |

FIG. 10 ABBREVIATION OF #2 LETTERS

| | | | | | | | | | | | | | | | | | | | | |
|---|---|---|---|---|---|---|---|---|---|---|---|---|---|---|---|---|---|---|---|---|
| 1 | A | B | C | E | F | H | I | J | L | M | N | O | P | R | S | U | V | W | Y | |
| 2 | A | B | | E | F | H | I | J | L | M | N | O | P | R | S | U | V | | Y | |
| 3 | A | | C | E | F | H | I | J | L | M | N | O | P | R | S | T | U | V | W | Y |
| 4 | A | | C | E | | H | I | | L | | N | O | P | R | | T | U | | W | Y |
| 5 | A | | C | E | | H | I | | L | | N | O | | R | | | U | | X | |

DICTIONARY INDEX

BACKGROUND—FIELD OF INVENTION

This invention relates to dictionaries, specifically to an improved index for a dictionary.

BACKGROUND—DESCRIPTION OF PRIOR ART

Heretofore the basic structure of dictionary indexes was to have a chart of alphabetized letter categories on the cover of a dictionary, arranged in columns from top to bottom of the book, and also to have only one designation on a page edge—either a tab or printed mark—for each category, this designation directly across from each category on whatever page the words of each category appears in the book. This prior art determined for dictionaries different categories for words of different first letters.

Considering the letters of the alphabet and all the words that begin with each letter of the alphabet, the inventor refers to the first letter of a word as the #1 letter, the second letter as the #2 letter, and the third letter as the #3 letter.

Prior art's determining different categories of #2 and possibly further letters for each #1 letter began in early prior art—before 1887 in the inventor's framework—with the consideration that if a particular #1 letter (for instance "C") had twice the pages of words as another #1 letter (for instance "E"), that the former #1 letter should have about twice the categories of the latter #1 letter. Throughout the 26 #1 letters, the determination of number of categories of each #1 letter was approximately relative to the number of pages of #1 letters in the book.

Whether or not this determination of relative number of categories persisted as an assumption in later prior art, after 1887, later prior art still determines different categories for different #1 letters, with one designation per category. Determining different categories for different #1 letters was also supported by the practice that there were other reasons to tailor and design the #2 and possibly any further letters individually for different #1 letters, apart from the number of pages of #1 letters involved.

As an example of this, if in prior art it was determined that #1 letters A and C were each to have the same number of categories, the #1 and #2 letters of the first three categories for A might be "Ab," "Ac," "Ad"; while the first three categories of C with both #1 and #2 letters might be "Ca," "Ce," and "Co." (These categories are found in 1887 U.S. Pat. No. 371,791.) This is partly out of appreciation for the fact that when designing the categories for a vowel as a #1 letter, that often that vowel will be followed by a consonant; and on the other hand a consonant as a #1 letter will often be followed by a vowel. In prior art it could seem inappropriate for the first three categories of #1 letter C to be "Cb," "Cc," "Cd," the same #2 letters as for #1 letter A above, as there is little frequency of such words. Further, it may be noted that each vowel does not have the same frequency of the same consonants as #2 letters, nor each consonant the same frequency of the same vowels as #2 letters; and that varying among #1 letters some consonants follow consonants and some vowels follow vowels. Prior art had different reasons to determine different categories for different #1 letters, even if there were to be the same number of categories for any #1 letters.

Prior art's determining for dictionaries different categories for different #1 letters results in the fact that the total number of designations on page edges is equal to the total number of categories in the chart on the cover of the dictionary. This gives a total of perhaps 100 or 200 or more categories, a number of categories that is so large that the user has tended not to be able to memorize or become comfortable with them quickly, so that the user has tended to have to read over the categories with each use for a significant period of time.

Prior art has more than two columns in the chart to accomodate its categories, with usually more than one letter in each column, so that the structure of the charts in prior art were wide and relatively inconvenient to handle, as well as significantly more expensive to manufacture, as compared to the type of cover that is common on most hardback books.

Prior art dictionaries provided limited help in locating words in dictionaries, being that apart from the relatively large number of categories in the chart they had, they did not have enough designations on page edges to help the user more closely locate any word.

Prior art is largely oriented to comparisons of number of pages of #1 letters, with little orientation to comparison of number of pages of #2 letters.

What is needed is a system of categorization and designation that routinely violates a certain sense of appropriateness by including #2 letter consonants and vowels following #1 letter consonants and vowels respectively, where such are seldom found in actual words, which system is also oriented to the comparison of pages in the dictionary for each #2 letter.

What is needed for dictionaries is to have the same categories for any #1 letters, with approximately twenty to twenty-six designations on page edges for each category. What is needed is: significantly fewer categories in the chart for quicker and more comfortable operation—a total for both #2 and #3 letters of about 20 to 60 categories; a system wherein there are at the most two vertical columns, with at the most one letter in any column, to make the book be more convenient to handle and also more economical to manufacture; more designations on page edges more adequately to help locate words, approximately 400 (20×20) to 1200 (60×20) total designations.

OBJECTS AND ADVANTAGES

Besides being an object of this invention to satisfy one or more of the areas presented above as what is needed, it is to be noted that this invention shares the following objects held in common with many of the distinguished predecessors in the development of dictionary indexes.

It is an object of this invention significantly to reduce the average length of time involved in looking up a word in the dictionary.

It is another object of this invention to reduce an annoyance that may be involved in looking up words in the dictionary.

It is another object of this invention that people use dictionaries more due to this increased convenience of using dictionaries.

It is another object of this invention to increase peoples' literacy and ability to the extent that such can be increased by more adequate dictionary use.

Further objects and advantages of my invention will become apparent from a consideration of the drawings and ensuing description thereof.

DESCRIPTION OF DRAWINGS

FIG. 7 is a table listing how many total pages in a dictionary there are for each #2 letter.

FIG. 8 is a table detailing how many #3 letters there are for each listed #2 letter proportionally when #2 letter A has from 1 to 6 #3 letters.

FIG. 9 is a table detailing what the empirical #3 letters are depending upon how many #3 letters are desired for any of the listed #2 letter vowels.

FIG. 10 is a table detailing five different alternatives of abbreviation of #2 letters, where some of the #2 letters are deleted from being included in the chart.

Drawing Reference Numerals:

Figure 2:
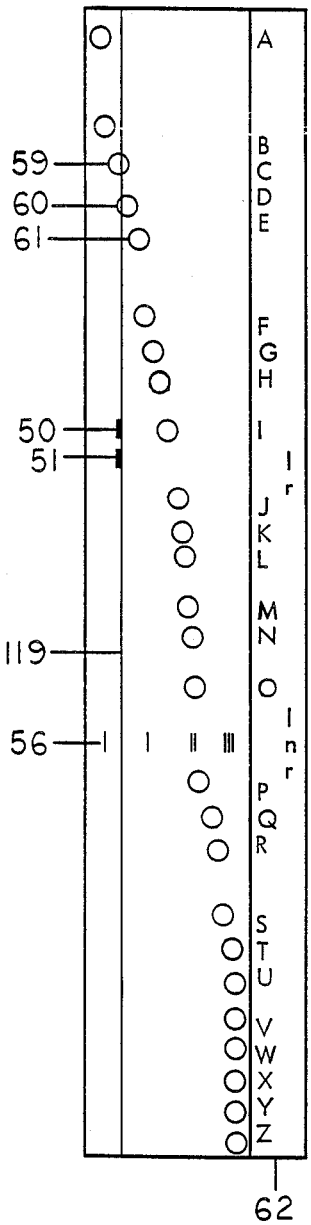
FIG. 2 shows a simplified top view of the #1 letter marks on all the length page edges for all the twenty-six #1 letters.
Figure 5:
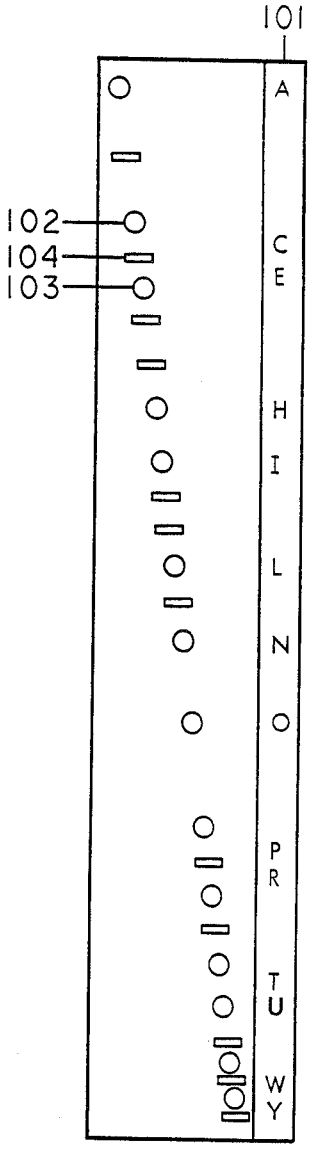
FIG. 5 shows a simplified top view of #1 letter marks on all the length page edges for all the twenty-six #1 letters, with some of the #1 letters deleted from the chart.
Figure 6:
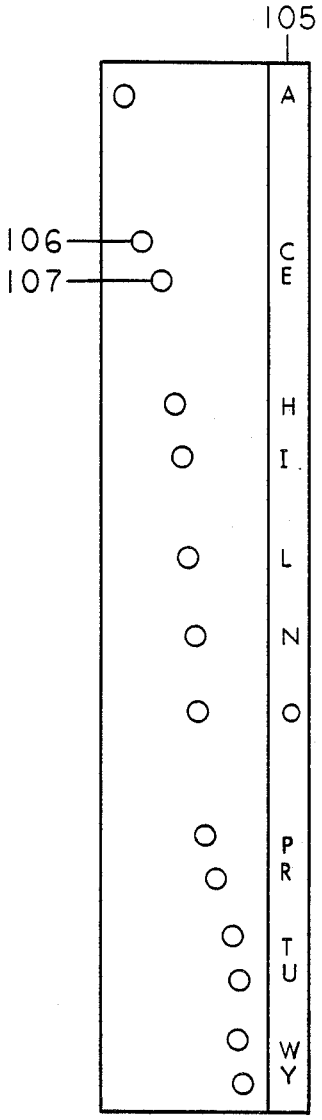
FIG. 6 shows a simplified top view of #1 letter marks on all the length page edges for only those #1 letters shown in the chart, with some of the #1 letters deleted from the chart.

9 chart
10 break-out section
11 dictionary
12 ledge
13 pages
14 length edge of pages
15 #2 letter column
16 #3 letter column
17 #3 letter n
18 #2 letter E
19 ledge strip
20 break lines
21 #1 letter C pages
22 #1 letter D pages
23 #1 letter E pages
24 first page #1 letter C
25 first page #1 letter D
26 first page #1 letter E
27 #1 letter boxes
28 cross transverse aligner
29 #1 letter boxes
30 circle transverse aligner
31 tab
32 mark transverse aligner
33 #1 letter boxes
34 cross transverse aligner
35 box for #1, #2, #3 letters C-E-n
36 box for C-R-e
37 #3 letter category e under #2 letter R
38 diagonal line for #1 letter C
39 diagonal line for #1 letter D
40 diagonal line for #1 letter E
41 partial diagonal line for #1 letter B
42 partial diagonal line for #1 letter F
43 #2 letter L in chart
44 box for #1,#2 letters C-L
45 box for #1, #2 letters D-L
46 box for #1, #2 letters E-L
47 long box for #1, #2 letters C-O
48 short box for #1, #2, #3 letters C-O-l
49 colored box for #1, #2, #3 letters C-O-r
50 box for #1,#2 letters C-I (same page box 51)
51 box for #1, #2, #3 letters C-I-l (same page box 50)
52 box for #1, #2 letters C-X (no such word)
53 tab for #1, #2 letters C-S
54 single listing box for #1, #2 letters C-U
55 strict multiple listing, for #1, #2, #3 letters C-H-i
56 add rule in FIG. 2 for #1, #2, #3 letters B-O-n, F-O-n, N-O-n, S-O-n
57 colored added box for #1, #2 letters C-F
58 extended multiple listing for #1, #2 letters C-H
59 #1 letter mark for C (FIG. 2)
60 #1 letter mark for D
61 #1 letter mark for E
62 chart
63 bottom dictionary (FIG. 3)
64 ledge
65 back cover
66 length edge of pages
67 #1 letter D
68 oblique line of line segments for #1 letters A to H
69 oblique line of line segments for #1 letters I to Q
70 oblique line of line segments for #1 letters R to Z
71 line segment #1 letter S
72 line segment #1 letter T
73 spine
74 dictionary (FIG. 4)
75 ledge
76 break lines
77 length edge of pages
78 chart
79 single column
80 #2 letter L in chart
81 #3 letter r in chart, under #2 letter E
82 #3 letter l of #2 letter O in chart in different type
83 first pages #1 letter C
84 first pages #1 letter D
85 first pages #1 letter E
86 first pages #1 letter F
87 #1 letter C pages
88 #1 letter D pages
89 #1 letter E pages
90 some pages #1 letter B
91 some pages #1 letter F
92 diagonal line for #1 letter C
93 diagonal line for #1 letter D
94 diagonal line for #1 letter E
95 extended multiple listing for #1, #2, #3 letters C-E-r
96 extended multiple listing for #1, #2 letters C-H
97 #1 letter mark for C
98 #1 letter mark for E
99 #1 letter mark for D
101 chart (FIG. 5)
102 #1 letter mark for C
103 #1 letter mark for E
104 #1 letter mark for D
105 chart (FIG. 6)

106 #1 letter mark for C
107 #1 letter mark for E
109 colored rectangular space for #1 letter C in chart
110 colored rectangular space for #1 letter A in chart
111 colored rectangular space for #1 letter E in chart
112 colored rectangular space for #1 letter H in chart
114 colored silver for #1 letter D deleted from chart
117 alternative location of chart on length page edges (FIG. 3)
118 hole for #1, #2, #3 letters C-R-i
119 the same page that both boxes 50 and 51 are on.

DESCRIPTION AND OPERATION

Figure 1:
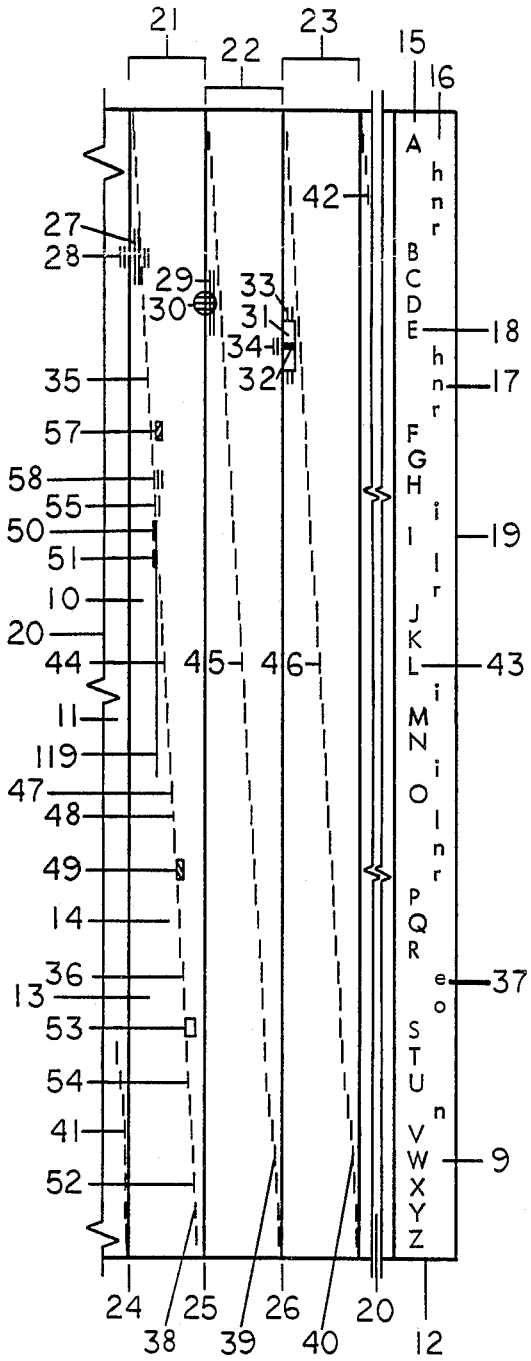
FIG. 1 shows a top view of one embodiment of the invention, with basically just length page edges for #1 letters C, D, and E with a two column chart.
Figure 3:
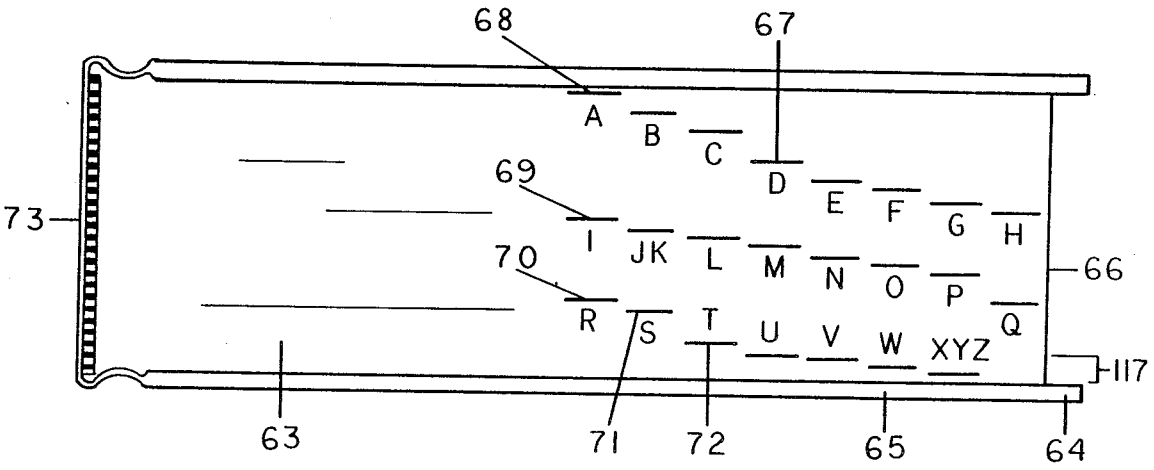
FIG. 3 shows a bottom view of the dictionary with a lines segments means to identify #1 letters.
Figure 4:
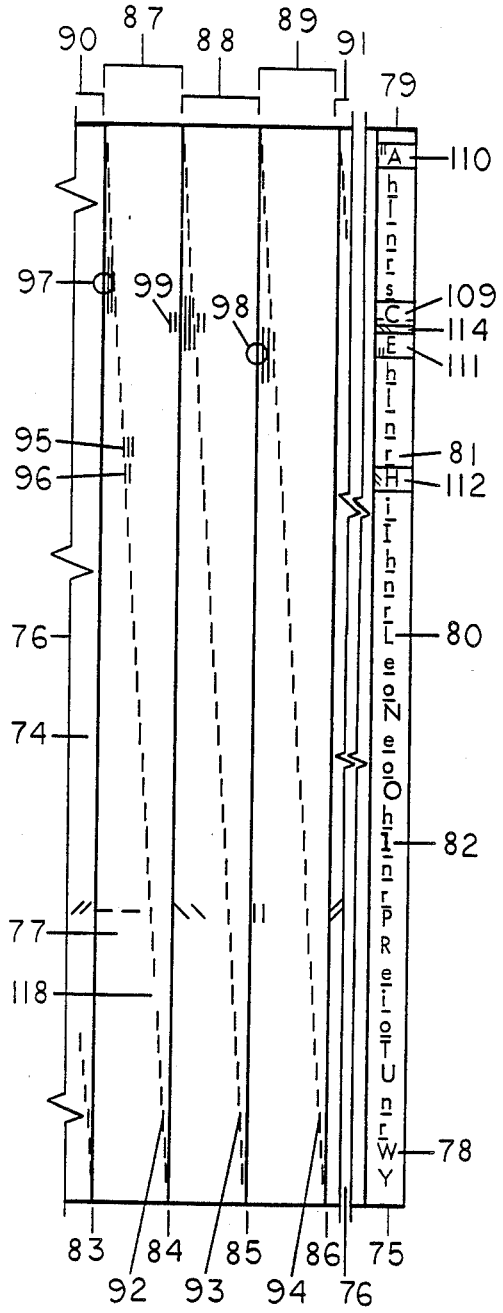
FIG. 4 shows a top view of one embodiment of the invention, with basically just length page edges for #1 letters C, D, and E with a one column chart.

Description and Operation will be provided rather separately for FIG. 1, then for FIG. 2, then for each of the remaining figures, towards presenting the information in satisfactory gradations. FIG. 1, FIG. 2; FIG. 3; FIG. 4, FIG. 5; FIG. 6; FIGS. 7, 8, 9, 10; are on the 1st; 2nd; 3rd; 4th; 5th pages of drawings respectively.

FIG. 1 is a top view of one embodiment of the invention, showing a chart 9 on the back cover of the dictionary, and a section 10 of the pages of the dictionary, for mainly the #1 letters C, D, and E. It would have been repetitious and not particularly helpful to include all the pages of the dictionary, which would also have required reducing in size the pages for any particular letters to demonstrate the invention.

A basic statement of how this invention works continues from this point through the second paragraph following the section with the title heading "Some Terminology," which section has only four paragraphs. This basic statement up through that just stated paragraph shows an embodiment of this invention where the person using this dictionary index is shown to make two separate openings of the dictionary: first the person opens the dictionary to the start of his #1 letter, and then in the second opening the person opens to the start of the #2 letter and in that same second opening possibly also opens to the start of the #3 letter. Within this basic statement of this embodiment several alternative means will be shown to locate the start of any #1 letter. Within this basic statement the parts of the invention will be described, and the structural coordination of the different parts will be seen to one another. In the second paragraph following the section "Some Terminology" a basic statement of operation detailing the two openings will be provided for those then described basic parts. With the basic operation of this invention then understood, from that point on this overall section "Description and Operation" continues with further refinements and embodiments.

This invention applies to a dictionary 11 and to any book containing alphabetized entries. the term dictionary will often be used alone, with the understanding that other books of alphabetized entries are also being referred to, such as telephone directories and encyclopedias.

Ledge 12 is that part of the inside of the back cover that extends beyond the pages 13 of teh dictionary when the dictionary is open or closed. Edge 14 is the length edge of the pages, away from the spine of the dictionary but parallel to the spine. Column 15 on the ledge 12 shown in capital letters is for the #2 letters. Column 16 on the ledge 12 shown in lower case letters is for the #3 letters. Any #3 letters for instance h, n l, r are subcategories of whatever #2 letter they follow, in this case #2 letter E 18. Any chart, such as chart 9, is preferably arranged lengthwise, parallel with the spine, with each successive category—whether a #2 or a #3 letter—at a different length position. With two columns it is apparent that any successive category need not be directly below the preceding category.

Any chart, such as chart 9, may be on a strip 19 of material that is adhered to the ledge 12, or any chart may be printed directly on the material of the ledge. The length page edges of mainly #1 letters C, D, and E are shown in break-out section 10, which section 10 is bounded on each its left and right side with break lines 20.

Pages 21 are those successive pages in the dictionary that include all the words of the #1 letter C. Pages 22 are those pages in the dictionary for the #1 letter D. Pages 23 are those pages in the dictionary for the #1 letter E.

Page 24 is the first page of #1 letter C; page 25 is the first page of #1 letter D; and page 26 is the first page of #1 letter E.

There are different alternatives to identify where any #1 letter begins in the dictionary, the immediately following of which use the letters in column 15 not only to refer to #2 letters, but also to refer to #1 letters. Depending upon the purpose for which it is used, a letter in column 15 may be referred to as a #2 letter or as a #1 letter, or more broadly as a #1–#2 letter. A mark printed on an edge of a page is referred to here as a "box," and #1 letter boxes 27 begin on the first page 24 of #1 letter C. #1 letter boxes 27 has "boxes" in the plural being that here a box is repeated on several successive pages for magnified viewability. There is a cross 28 which extends from each side of #1 letter boxes 27, this cross 28 approximately across from where its respective letter "C" is in column 15. Considering any alternative to locate the beginning of any #1 letter, where all 26 letters are shown as #1–#2 letters in column 15, that alternative would be used throughout, for each #1 letter. The foregoing can be referred to as the #1 letter box 27-cross 28 alternative, or merely #1 letter mark 27-28.

Another alternative to locate #1 letters are #1 letter boxes 29, which are the same as #1 letter boxes 27, except here a circle 30 of preferably a different color for instance red is printed in the middle of the length of #1 letter boxes 29. This alternative #1 letter boxes 29-circle 30 or #1 letter mark 29-30 is shown here from the first page 25 of #1 letter D, with circle 30 approximately across from the "D" in column 15.

Another alternative to locate #1 letters is the tab 31 projecting out from first page 26 of #1 letter E, which tab 31 has a mark 32 at its center approximately across from the letter E in column 15. This #1 letter mark has boxes and a cross to be of service if the tab ever breaks off, #1 letter boxes 33 showing above and below the tab 31, and cross 34 showing here to the left of tab 31.

Any of the preceding #1 letter marks 27-28, 29-30, or 31-32-33-34 shows where to open a dictionary to find the beginning of any #1 letter, the subject of finding the beginning of #1 letters later further to be described.

Box 35 is a mark printed on the edge of a page within the pages 21 for #1 letters C, which box 35 is directly across from #3 letter n 17 in column 16, which #3 letter n 17 is a subcategory of #2 letter E 18 in column 15. A person wishing to find in the dictionary where #1,#2,#3 letters C-E-n first begin would open the dictionary at box 35, as that box is placed on the edge of the first page of C-E-n.

Box 36, also within #1 pages 21 for C, is directly across from #3 letter e 37, which #3 letter e is a subcategory of #2 letter R. Box 36 signifies where the first page of those words that begin with C-R-e begin, such as the word crease. The length page edge a #3 designation is located on is the page of its #1, #2 letters where respective #3 letter in chart is to be found.

In like manner within the pages 21 for those words that begin with C, there is a box on the edge of a page for each #2 letter and each #3 letter in the chart 9. Notice that box 36 is further to the right than box 35. This is because box 36 is for a category that is alphabetically later than the category for box 35, and is therefore on a later page further to the right. A box for each of the categories in the chart on the pages of #1 letter C results in diagonal line 38 of boxes, a box on the first page of the #1 letters C being maximally on the left; a box on the last page of the #1 letters C being maximally on the right within the pages 21 for #1 letter C, with there being a diagonal line of boxes proceeding between.

In like manner there is a diagonal line of boxes for each #1 letter that is so treated. diagonal line 39 is of all the boxes for #1 letter D, and diagonal line 40 is of all the boxes for the #1 letter E. FIG. 1 shows a minor part of the diagonal lines for two other #1 letters: diagonal line 41 is the end of the boxes for the preceding #1 letter B; and diagonl line 42 is the very beginning of the boxes for the following #1 letter F. The mass of page edges for all the pages 13 in the dictionary 11 are not drawn into FIG. 1 or any later figures, as the drawings are more clarifying and less cluttered in this form.

All of the boxes in any diagonal line across from any same category in chart 9 have the letter of that category in common. For instance #2 letter L 43 has across from it box 44 to show where #1, #2 letters C-L start, and also box 45 for #1, #2 letters D-L, and also box 46 for #1, #2 letters E-L. In this way each category in the chart has a length page edge designation for each #1 letter so treated with a diagonal line.

SOME TERMINOLOGY

"Designation" refers to a particular indication on a length edge of a page, and such an indication may be physically expressed as a printed box or a tab, or any equivalent means to make an indication on the edge of a page. Anywhere in this Specification that a box is referred to for a #2 or #3 letter, a tab or an equivalent indication may instead be used. For purposes of serving a comfortable shorthand, a #2 letter box may be referred to as a #2 box, or more broadly as a #2 designation; and a #2-#3 letter box may be referred to as a #3 letter box or a #3 box or more broadly as a #3 designation. While when a person reads "2#2 designation" or "#3 designation," he knows each can be shown with a box or a tab or an equivalent indication, when a person reads "designation" by itself, that refers broadly to a particular indication on the edge of a page for a #2 designation or a #3 designation. "Designations" refers to more than one #2 designation, more than one #3 designation, or one or more of each #2 designation and #3 designation.

A category refers to whatever increments there are in the chart, #2 letters with or without #3 letters, though subcategory refers only to #3 letters. A chart may have only #2 letters in it, though there is an advantage of added precision in locating words in #3 letters also being included. A category always has its respective counterpart on a page edge of a designation.

When it is written here that a person would look in the chart for his #2 letters and "possibly" #3 letter, the reason for saying possibly is that the chart may not have his #3 letter included.

A designation is located at least on the first page where its category in the chart is first found in the dictionary. An open dictionary has an open left hand page and an open right hand page before a person. If a word of a chart category is first found on either of these two open pages, a designation is routinely put on the right hand edge of the right hand page, such designation said to be located on the "first page" of that category. A "successive page" means the right hand page of the following set of open pages.

Continuing, with this terminology now presented, as an option some #1 letters such as J, K, Q, X, Y, and Z may not be so treated and so not have #2 boxes with or without #3 boxes and so have no diagonal lines printed for them, for the reason that there are so few pages of such #1 letters that it may be considered that adequate locating of any words beginning with such letters is furnished with just showing where each such #1 letter begins.

With a separate diagonal line of #2 and #3 boxes for each #1 letter so treated, to locate any particular word, first the person using this index opens the dictionary to where his particular #1 letter begins—for instance by means of any of the #1 letter marks alre With this opening the person has before him at the top of the pages to the right the diagonal line of boxes for his #1 letter, with other diagonal lines for later #1 letters beneath his desired diagonal line. Next by referring to the chart the person picks out his particular #2 letter category and if there are #3 letter categories for that #2 letter, the person picks out the closest #3 letter category. Then looking directly across from the category in the chart to his diagonal line, the person picks out his particular box within that diagonal line and next further opens the dictionary to the page with that box, and so is brought quite close within the dictionary to the page where his word is actually located—often requiring no more than two or three page turns to find his particular word.

While this has been some of the basic description and operation of FIG. 1, some further particulars are now to be provided.

Two adjacent designations in any diagonal line should be viewably separated from each other by a space measured lengthwise along the length edge of a page—existing between them. Within the same diagonal line, if the bottom of one box were directly across from any part of the next box lower, and this condition of being partly at the same level existed for all adjacent boxes, viewably this could appear to be one continuous diagonal line so that a person could not pick out so readily which box was directly across any category. The length distance between the closest parts of adjacent boxes in the same diagonal line is about one to three millimeters.

The length of any #2 or #3 box measured along the length edge of a page will be approximately three to six millimeters, depending on how many boxes are to fit into whatever is the length of the page. There can be an advantage in differentiating a box for a #2 letter from a box for a #3 letter. Sometimes the pages in a dictionary get slightly skewed so that while looking directly across from a chart category, a person might pick out the wrong box. By the #2 and #3 boxes being differentiated, a person will see extending from each category a particular kind of designation periodically repeated transversely through the page edges. A #2 letter in the chart will have a particular kind of box repeated transversely through each diagonal line; and a #3 letter in the chart will have a different kind of box repeated transversely through each diagonal line, so that a person can have his attention follow whatever transverse repeated line of boxes from his category in the chart to his own desired box, despite whatever skew.

One way to differentiate #2 and #3 boxes is by their length. Notice that #2 box 47 for #1, #2 letters C-O is longer than #3 box 48 for #1, #2, #3 letters C-O-l. Another way to differentiate #2 and #3 boxes is by color: #2 boxes can be for instance black and #3 boxes for instance green—especially if #2 letters in the chart are printed in black, and #3 letters in the chart are printed in green. #2 box 47 is in black, and #3 box 49 for #1, #2, #3 letters C-O-r is shown as a rectangle, signifying here the color green. There may be differentiation in both length and color. A color difference is more noticeable but often costs more than a length difference.

Such differentiation between #2 and #3 boxes is preferable for instance to additional actual lines printed across the page edges from any chart category to help in the alignment, as such alignment lines may tend to interrupt and confuse the sense of continuity of a person dealing with diagonal lines.

Only part of any box printed on the edge of a page will usually be viewable to the user, as the other part of the same box will usually be blocked from view as it is behind the page preceding it. With the dictionary open and the spine of the dictionary pressed flat against a table, concerning the edges of the pages located to the right of the open dictionary, those pages are not located directly in a vertical line, but there a lower numbered page is pulled more to the left than a higher numbered page so that a higher numbered page "peeks out" from behind a lower numbered page. This peeking out will be referred to as "underlap." It is because of this underlap that there is an advantage in locating the boxes for #2 and any #3 letters when the dictionary is already open, spine pressed flat against a table, to the start of the #1 letter, as the boxes are pulled more into view.

As a substantial part of the boxes will be blocked from view by preceding pages, it doesn't particularly matter if a box is printed for instance as a rectangle, or as a half circle with a full diameter of the circle along the page edge—as most of the box will not be seen anyway. While the inventor prefers a rectangle, whatever is the shape of a box, a suitable printed distance for a box along the width of a page is about five millimeters, with the recognition that most of this five millimeters will not be in view.

In some cases there will be more than one designation on any length page edge, whether more than one #2 designation, more than one #3 designation, or a combination of #2 designation and #3 designation, depending on how many categories are first found on that set of open pages. For instance box 50 for #1, #2 letters C-I is shown on the same page 119 as box 51 for #1, #2, #3 letters C-I-l, what with boxes 50 and 51 being perfectly vertically aligned. Boxes 50 and 51 are also shown in FIG. 2 on same page 119, where the complete length edge of page 119 is also shown.

If there is no word in the dictionary for any letter in the chart, whether a #2 or #3 letter, for instance no word starting with #1, #2 letters C-X, a designation is put on such a page where the word would have been if there were such a word—or else there would be a hole in the diagonal line, which hole could tend to confuse the user's continuity. Box 52 for #1, #2 letters C-X is shown in FIG. 1 as an example. An example of a designation as a tab is tab 53 for #1, #2 letters C-S, which tab extends about one to four millimeters from the page edge.

REPEATING BOXES TO INCREASE VISIBILITY

The underlap of a single page is not sufficient for some people readily to see a box peeking out. Therefore several alternatives are provided so that boxes for the same chart category for the same #1 letter are repeated on successive pages. Where there is no repetition, we have "single listing." Single listing is each category in the chart having only one designation in the pages of the dictionary for any #1 letter, or stated more broadly, for any #1 letter any #2 designation and any #3 designation is only on the first page of any pages of words that have such #2 letter and such #3 letter respectively in the chart. #2 and #3 boxes in the drawings for the most part are shown as single listing. For instance box 54 for #1, #2 letters C-U is a box according to single listing. Another alternative for single listing, if there are three or more successive pages for any category, is to put the designation approximately on the middle page of those successive pages.

"Strict multiple listing" is the repeating of a designation on every right hand page of every set of open pages where that category is found in the dictionary. In strict multiple listing there will not be a box on every page, being that for instance between some two #3 letters there may be some pages with neither of those categories on them—for instance after box 48 for categories C-O-l there may be some pages of non-category C-O-m before the next category of C-O-n is reached. In strict multiple listing boxes for any #2 letter are provided as if the #3 letter is an "a"—for instance boxes 47 for #1, #2 letters C-O are provided on any pages that have C-O-a, if strict multiple listing had been applied.

As an example of strict multiple listing, there are boxes 55 for #1, #2, #3 letters C-H-i, where two boxes are shown, signifying that words with the fist three letters C-H-i are here found on both of these two sets of open pages.

In some cases strict multiple listing may still not provide enough repeated boxes to be able readily to see underlaps on those pages. Notice that in opening a dictionary to the #1 letter A, and also pressing the dictionary's spine to a table, that in the page edges at the right there is more underlap of the lower numbered pages than of the higher numbered pages. This is due to the lower numbered pages being bent in a bigger curve close to the spine than the higher numbered pages. Therefore there is an advantage in providing additional boxes for higher numbered pages as compared to lower numbered pages to make the total boxes at any location as conspicuous.

Dividing rather arbitrarily the dictionary's pages into four quarters—the pages of the first, second, third, and fourth quarters, there is an advantage in deciding that the total number of pages of boxes for any category shall be for these respective four quarters a minimum of 1, 1, 2, 3; or 2, 2, 3, 4; or 3, 3, 4, 5. Different people will prefer different minimums. Or the dictionary may be divided into other sections—instead of quarters for instance thirds, with there being for the first, second, third thirds of the dictionary the minimum for instance of 2, 3, 4 boxes respectively.

This the "add rule," which says that designations shall be added to successive length page edges where necessary to meet a predetermined minimum number of successive pages with designations, this minimum number increasing for sections of the dictionary with higher numbered pages. These boxes are to be added on the successive pages at the appropriate category level even though the letters of any such category may not be found on those successive pages. As an example of the add rule, in FIG. 2—which figure will later be more fully introduced—there is a succession of four sets of boxes 56 across from #2, #3 letters O-n. these four sets of boxes from left to right are for #1, #2, #3 letters B-O-n, F-O-n, N-O-n, and S-O-n respectively. There is one of each set of boxes in each of four quarters of the dictionary, and here the add rule is applied to single listing so that there are 1, 1, 2, 3 boxes in the four quarters 1, 2, 3, 4 respectively.

It is valuable to print any added boxes in a different color than the color of any boxes present before the application of the add rule, for instance blue, so that a person can see that his category is not necessarily being identified to be found on those added pages. Box 57 for #1, #2 letters C-F is an example of a colored added box, two boxes being shown in FIG. 1 for #1#2 letters C-F with the second box 57 being an added box and shown as a rectangle to signify a different color.

As another part of this add rule, being that some #1 letters have few pages so that a successive diagonal line may come close to the first diagonal line in question, it may be determined that there shall be for instance for the four quarters 1, 2, 3, 4 respectively at least for instance 2, 2, 3, 4 pages of no boxes between boxes for the same #2 or #3 category in adjacent diagonal lines, or else boxes will be reduced from the preceding added boxes accordingly. This prevents any possible meeting of boxes of successive #1 letters, or their visually appearing too close. By not so treating those #1 letters that have relatively few pages with boxes in diagonal lines, this "reduction to the add rule" will seldom need to be applied.

Another means to repeat boxes and so increase visibility of underlap for any category is "extended multiple listing." With extended multiple listing there is a box on every page. In extended multiple listing a designation is provided on the first page for each category and repeated on every successive page, stopping only at the page where the next designation begins, whether the next designation is for a #3 letter or a #2 letter—though a designation not being repeated on any page beyond its own #2 letter.

As an example of extended multiple listing there are boxes 58 for #1, #2 letters C-H. These three boxes 58 signify that in this dictionary words with letters C-H or C-H-a up to C-H-h are found on these designated three open sets of pages, after which the next category C-H-i begins.

Looking at a repeated box on a working model of this invention, a person would see a single mass of boxes, one box blending into another. But in the drawings in the interest of showing that more than one underlap is involved in a repeated box, a space is shown between such underlaps. This drawing convention to emphasize more than one underlap also resulted in some of the underlaps for either of the multiple listings appearing to be on a later page than a box of a following category, whereas in actual fact a box of a following category would be on the same page or on a later page.

Extended multiple listing while having the greater expense of printing more boxes as compared to strict multiple listing, has increased visibility of more underlap as compared to strict multiple listing. Either of these multiple listings has another advantage in that by any category's respective number of repeated boxes, a person can approximate where any #3 letters not included in the categories is to be found in the dictionary's pages.

The add rule may be applied to single listing, strict multiple listing, extended multiple listing, or any design of listing a person determines.

While the inventor prefers boxes as designations to tabs, tabs may also be used to serve the value of greater visibility and more immediate location by touch. On the other hand tabs have disadvantages besides tending to be more expensive and fragile, that with the many designations to be found on a dictionary's page edges with this invention, reinforced tabs on page edges would tend significantly to increase the depth of pages at their length edge.

ACCOMMODATIONS FOR PAPERBACK DICTIONARIES

This invention applied to a paperback dictionary in a preferred embodiment needs the back cover to extend beyond the length edge pages so as to allow for a chart on a ledge. With some paperback books when the book is opened, the spine curves. The spine curving is an undesired condition, as this reduces underlap. The paperback spine preferably has a minimum amount of curve when the book is opened.

With each new paperback dictionary that is issued, an additional page made of the same material as the back cover may be issued, and on this additional page there be several charts printed, each chart the same as the chart on the back cover, these several charts separated from each other by about an inch so that if the ledge of the original dictionary becomes worn, a chart may be removed from this additional page, perhaps accomodated by page perforations, and taped over the original ledge, and itself be replaced as it becomes worn.

Means may be provided to allow the ledge on a paperback to be moved so that it does not extend past the length page edges when the dictionary is not in use. The back cover may merely be folded at the point where the ledge meets the length page edges, folding the ledge inside the book. Such folding has the drawback of tending to weaken the cover material at the location of the fold.

Another alternative at a position on the inside back cover beginning about 4 centimeters from the length page edges is to have a strip of material extending along the length of the back cover, this strip then passing over the top and bottom of the back cover about 1 centimeter, this 1 centimeter above and below then folded back on the back of the back cover and then adhered, perhaps glude, in position. This provides a pocket between this strip of material and back cover, inside of which pocket a partial page may slide toward and back from the length page edges. On the right extremity of such a partial page the constructor is to put a chart. In a preferred embodiment of such a slideable partial page, the constructor makes a fold in this partial page, so that the folded material of this partial page passes over the strip of material adhered in position. The right edge of this folded material is then adhered in position to the partial page, so that there is a particular distance between the fold and where this latter adhering begins. The constructor makes this particular distance be equal to the width of the strip of material plus the width of the chart—so that when this partial page is pulled to the right its maximum distance, where the fold will meet and touch along the strip of material, the chart extends past the length edge of the pages the width of the chart, putting the chart in view with no particular careful alignement on the user's part. With this strip of material with partial page alternative, there is a maximum left and right distance the partial page may slide before it meets the strip of material; and the chart may be slid inside the back cover so that it does not extend past the length edge of the pages when not in use.

LOCATING THE #1 LETTER

The #1 letter boxes 27-cross 28, the #1 letter boxes 29-circle 30, and the tab 31 with mark 32 at its center with #1 letter boxes 33-cross 34 may be termed as a group "#1 letter marks." Here with any #2 letter in the chart also referring to a #1 letter, and with a #1 letter mark approximately across from its respective #1 letter and being on the length edge of at least the first page of such #1 letter, the operation of locating the start of any #1 letter with #1 letter marks consists in locating the desired #1–#2 letter in column 15, noting the #1 letter mark approximately across from it, and opening the dictionary at that particular #1 letter mark. The #1 letter marks proceed in a single, rather oblique line across the length edges of the pages, from close to the front of the dictionary at the top for #1 letter mark A, to close to the back at the bottom for #1 letter mark Z.

In a #1 letter mark a cross 28 or a circle 30 or a mark 32 at the center of a tab 31 can be referred to generically as "transverse aligners," which aid in aligning the #1 letter marks transversely from the #1 letters in column 15. A transverse aligner's length distance along the length of a page is about the same as the length of a #1 letter along the length of a page, the length of a #1 letter elsewhere often referred to as its height. A "#1 letter mark" can also refer to just boxes 27, 29, 33 or just to a tab 31 without any transverse aligner.

#1 letter mark alternative #1 letters boxes 27-cross 28 has advantages in that if #2 and #3 letter boxes are printed in black at the same time the pages of dictionary material are printed, #1 letter boxes 27 and cross 28 can be printed in that same color, for economy. #1 letter boxes (reference numerals 27, 29, 33) are approximately three to five times the length of a #2 letter box. A #1 letter box is printed on the first page of any #1 letter, and repeated on about five successive pages. A cross 28 is printed on about five preceding and successive pages to the first and last #1 letter box respectively. Instead of a cross 28, any other mark may be printed across any #1 letter boxes, being on such approximately five preceding and successive pages.

#1 letter mark alternative #1 letter boxes 29-circle 30 has advantages in being more visible, though costing more. While any #1 letter boxes can be printed in a color different from #2 and #3 boxes, for instance red, if #1 letter boxes 29 are printed in the same color black as the #2 and #3 letter boxes, a circle 30 filled in with the color red can be printed all the better to distinguish #1 letter marks from #2, #3 letter boxes. Printing red circles 30 can be accomplished for instance by pulling back the front and back covers, pulling the pages into maximum underlap position so as to have a greater target for greater accuracy, and for instance rubber stamping in the same stamping action such a circle on every #1 letter box on the page. Even if the circle does not fall directly centered on any #1 letter box, it will likely be touching it and at least be across from it. Instead of a circle 30 being printed on in a different color, a cross or any other shape of mark may be printed in a different color as an especially noticeable transverse aligner on #1 letter boxes.

#1 letter mark alternative tab 31 with mark 32 at its center with #1 letter boxes 33-cross 34 have advantages and disadvantages as already referred to. Before a tab is affixed to any page, the #1 letter box should already be printed on that page in the proper location. Should a tab break off, there would still be a cross 28 for that #1 letter, or a red circle 30 if that was decided to be prepared, in addition to the #1 letter boxes. A #1 letter tab is about the same length as a #1 letter box, and projects about two to five millimeters from the page edge.

#1 letter marks for adjacent #1 letters in column 15 need not be directly across from such letters, as being directly across would means the length distance between the same part of such #1 letter marks would be only the length distance between the column 15 letters referred to. For instance, #1 letter marks for #1 letters B, C, D, E placed directly across from those letters would be rather cramped together in a length sense and not comfortably distinguishable, while at the same time some of thelength space for the #3 letters in column 16 is utilizable. The #1 letter mark for B if included in FIG. 1 may be placed about the level of the #3 letter r of #2 letter A. (The #1 letter mark for B is shown in FIG. 2, which figure will later be described.) Concerning #1 letter mark for E, in this case tab 31, this may be placed as it is with its center mark 32 directly across from the top part #2 letter E's #3 letter h. The #1 letter mark for each of C and D can be placed as they are in FIG. 1, spaced in between.

Depending upon the length space of any #3 letters that is directly next to any adjacent #1 letters in column 15, the #1 letter marks for these adjacent #1 letters can be expanded into that #3 letter space in this "expanded vertical spacing" for #1 letter marks, so that the center of some of the #1 letter boxes or a transverse aligner for a #1 letter mark is approximately across from adjacent #3 letters in the chart. A person seeing for instance four #1 letter marks rather in a group apart from other #1 letter marks, and those four marks rather across from B, C, D, E—the person can readily determine which identifies the first pages of which #1 letter.

FIG. 2 is a condensed and simplified drawing of the type of drawing shown in FIG. 1 showing just a circle for any #1 letter mark, with circles 59, 60, 61 representing #1 letter marks for C, D, E respectively, all the #1 letter marks in FIG. 2 being circles showing that the same kind of #1 letter mark here is used throughout. FIG. 2 shows expanded vertical spacing for #1 letter marks for all 26 #1 letters, each #1 letter mark sometimes only approximately across from its #1 letter. Chart 62 is simplified by not showing #3 letters for this purpose, as when locating the #1 letter mark, at that moment the person is not yet paying attention to the #3 letters.

Seldom will a #1 letter mark intersect a diagonal line. The #1 letter mark beings on the first page of a #1 letter, and a diagonal line is close to that first page usually only for the first #1 letters in the alphabet, for instance A, B, C, D, E. #1 letter marks for from F on are further down the length of the page, whereas further down the length of a page designations in a diagonal line are often on pages further back from the first page of any #1 letter.

Thumb indexing is another alternative to locate #1 letters. Should any particular thumb index have more than one letter on it, and the person not want the first letter, the pserson can still open the thumb index to the first letter point; and if he wanted for instance the second letter printed on the thumb index, with the dictionary open to that thumb index point, he can fairly readily distinguish the second diagonal line from the diagonal line extending from the top page and choose his desired box from his desired diagonal line. Thumb indexing prepared on length edge 14 intersects rather often diagonal lines of #2 and #3 boxes, so such boxes for such an embodiment are preferably printed on such intersected pages in such a width that when the semicircles are removed from the pages for the thumb indexing, these #2 and #3 boxes will still show on the edges of these semi-circles. With thumb indexing any designation as a tab should be dispensed with when it intersects a thumb index and replaced with a box.

Another alternative is to locate the beginning of any #1 letters on the bottom edge 63 of the dictionary, as shown in FIG. 3, so as to remove any intersection with diagonal lines and so as to reduce some mental accomodation seeing #1 letter marks and #2 and #3 designations on the same length edge of the dictionary. The bottom edge 63 of the dictionary is fairly easily viewable in that a person sitting at a table with a dictionary on it can fairly easily lean back a little in his chair to see the bottom of the dictionary. In FIG. 3 ledge 64 is of the back cover 65, with length edge 66 also shown.

A #1 letter line segment is printed on the bottom edge of a page on the first page of each #1 letter and repeated on about five additional pages. As an example in the drawing, #1 letter line segment 67 is for #1 letter D. Notice that three oblique lines of #1 letter line segments are shown in this embodiment, with oblique line 68 being for letters A, B, C, D, E, F, G, H; oblique line 69 being for letters I, J-K, L, M, N, O, P. Q; and oblique line 70 for letters R, S, T, U, V, W, X-Y-Z. In this embodiment each line segment is labeled by for instance rubber stamping the letter names to the bottom of the dictionary as a separate process from the line segments being printed. In this embodiment up to the letter S the letter name for each line segment is on later pages in the dictionary than the line segment, for instance line segment 71 for S; but starting at line segment 72 for T the letter label is placed on lower numbered pages than the line segment out of consideration that from that point on where are not many remaining pages of the dictionary upon which to print letters on the edges.

Each of the oblique lines 68, 69, 70 is on the right half of the dictionary, beginning about halfway from the spine 73 and proceeding towards length edge 66. An advantage of being on the right half is that it is easier to open a book holding a finger to a position on this right half than it is on the left half.

Thumb indexing or tabs may instead be applied to the bottom 63 of the dictionary, in oblique lines on this right half, so that identification to identify the beginning of #1 letters at the bottom 63 of the dictionary is line segments, thumb index, or tabs.

#1 letter marks basically do not rely on underlap, as the person usually uses the #1 letter marks to open the dictionary from a closed position where there is no underlap (except for a slight concave curve in the length edges of pages in some hardback books due to the spine). It is for the reason of not relying on underlap that it is especially valuable for #1 letter marks to show on the very edge of pages, on the pages' thickness, as distinct from being on the front or back face of a page bordering its edge, and a type of ink that penetrates paper when applied to a face of a page is one means to apply ink to the very edge of a page.

OPENING THE DICTIONARY

Using any #1, #2, or #3 letter boxes it is best not to try to insert a fingernail between any pages at the point of any such box, as that can wrinkle and damage pages, besides usually being more difficult to do. To locate the beginning of any #1 letter, if a tab 31 is used, hold the dictionary on its spine, and touching a finger against the tab 31, allow the pages of lower numbers to fall away to the left. If no tab but a #1 letter box, touch and hold a fingernail against such box—in a vector with the fingernail pressing in towards the edge of a page but also pressing towards higher numbered pages—and allow the pages of lower numbers to fall away to the left.

Then to locate the beginning of one's #2 and possibly #3 letter, the user may agree it is convenient to touch the right thumb fingernail against the appropriate #2 or #3 letter box, holding down that page and pages of higher numbers beneath that page in perhaps the preceding vector. Use the left hand to graze over the pages at the top or bottom of the dictionary, so that the pages of lower numbers than where the #2 or #3 letter box is located will separate from the pages being held down. Then lift those separated pages away and to the left. With a small amount of practice a person may arrive from a closed dictionary to the beginning of his #2 and possibly #3 letter in three seconds. This becomes a quick 1, 2, 3 progression of motions, so that the person can feel that he is reaching almost directly to the desired word. Sometimes in looking up a word without a good index there may be some concern such as annoyance or discontent involved in the process; and in addition to saving time, by this invention's mapped out certainty of more closely finding words, such concern becomes less pronounced, so that a person can have less reservations against using the dictionary.

PRINTING THE #1, #2, #3 LETTER BOXES AND OTHER MARKS ON PAGE EDGES.

Here is an inexpensive way to apply different colors to page edges, or all the boxes to page edges. With each printing run of a page, take a stack or perhaps one thousand of the same pages from that printing run and lay them on a horizontal surface. Have an incline directly to the left of this stack, the incline perhaps at 170 degrees angle to the bottom of the pages, and slide the left edge of the pages to match up with the plane of the incline. A vertical plane at the top of the pages against the horizontal and incline will help position the pages. Have a printing mechanism on an adjustable track such that the printing mechanism will print at the same length level as it is moved across all the edges of the pages. The printing mechanism may be an inked wheel on a roller, a variation of a felt tip pen, or a long rubber stamp. While such a process will deposit ink on the face of a page at its edge and also on its very edge, a penetrating ink can also be used so that the ink goes through to the other side of the page. As the underlap of a page is sometimes not much thicker than the thickness of a page, printing on the very edge thickness of a page is a value for added visibility. With this 170 or so degrees the widths of any printed boxes on pages will be fairly narrow, but still wider than what is generally exposed in the underlap when the pages are actually used in the book.

SOME ALTERNATIVES TO IMPROVE VISIBILITY OF BOXES AND CHART.

Other ways to handle reduced underlap of pages towards the back of the dictionary are—having successively wider pages towards the back for more underlap; or causing the left edge of the back cover to be lifted up, pulling the pages over for more underlap.

There is an advantage in the chart on the back cover be repeated on the inside front cover ledge, as sometimes when a person opens a dictionary to look up a word, he needs to look up a word that he found within that first definition, earlier on in the dictionary, to understand the first definition. By having the chart also on the front cover ledge, the person can avoid having to close the dictionary so as to make use of the chart on the back cover.

On a thick, unabridged dictionary or a telephone directory some people may have trouble seeing on the chart on the back cover a letter, and aligning that letter all the way across towards the front of the book's pages to #2 and #3 boxes, so another option is to print, for instance rubber stamp, in a color different from other colors on the page edges, the chart down the very edges of the book's pages earlier in the book, for instance through pages for the #1 letter I, circumventing as well as possible intersecting #1, #2, and #3 letter boxes.

Notice that some hardback books on length edge 14 have small hills and valleys consistently repeated, wherein there is more underlap going up a hill, and less underlap going down the hill on the other side. It is preferable not to have reduced underlap at any point and to have consistent underlap. These hills and valleys are due to pages of books often being printed and then organized into separate bundles, a single bundle being perhaps ten sheets of paper, which sheets are folded in half at its center so that pages towards the outside of the bundle have to go around a larger circumference at the fold line, and are at a lower point than a page folded at the center of the bundle, which center page would be at the peak of the hill. These hills and valleys can be eliminated by having pages of different lengths so that folded the page edges are in a straight line, or by cutting off the edge of the pages at the low point of the valleys. A handling of the hills and valleys is helpful.

FIG. 4—SINGLE COLUMN; ABBREVIATION OF #2 LETTERS

FIG. 4 shows several variations from FIG. 1, among them being a single column in the chart, and also an abbreviation of the #2 letters.

In FIG. 4 dictionary 74 has ledge 75. Break lines 76 are shown on left and right sides of length edge 77 of pages for break-out section basically for #1 letters C, D, E. Chart 78 is in a single column 79. Within single column 79 are both the #2 and #3 letters, differentiated from each other, by for instance the #2 letters being in capitals and the #3 letters being in lower case. Also, a difference in color is preferable, with for instance the #2 letters black and the #3 letters red, the #3 letters being underlined in FIG. 4 to signify they are to be a different color. As an example, in column 79 L 80 is a #2 letter, and is in capitals; and r 81 is a #3 letter differentiated not only by being in lower case but also underlined to indicate a different color, red. #2 and #3 letters may also be differentiated by being in different type styles and/or being in different heaviness of type, in whichever case there being a difference in the kind of type for the #2 as compared to the #3 letters. Under #2 letter O in FIG. 4 and as compared to this #2 letter O, #3 letter 1 82 is in a different type and a different heaviness.

An advantage of a single column chart is that it can be fit onto the existing ledges of most dictionaries. A two column chart may involve the greater expense and unwieldiness of widening the ledge from its otherwise width. On the other hand a person may not be able to differentiate as readily the #2 letters from the #3 letters in a single column as compared to two columns.

Notice that there are fewer #2 letters in FIG. 4 as compared to FIG. 1, so that FIG. 4 shows an "abbreviation of #2 letters." Some of the twenty-six letters of the alphabet are relatively seldom found as #2 letters, so that there is less need to include these #2 letters in the chart, and they may therefore be deleted. Such deletion allows more space on the ledge to include more #3 letters, or to print letters in the chart in larger type; or to make letters in the chart lest cramped together; or to make designations of greater length. Notice in FIG. 4 that #2 letter E has four subcategories h, l, n, r; whereas #2 letter E in FIG. 1 has only three subcategories h, n, r. Notice in FIG. 4 that most of the #2 letters that have subcategories have more #3 letter subcategories than the respective #2 letters in FIG. 1 have, and still there are fewer total categories in FIG. 4 than in FIG. 1.

The first pages of #1 letter C, D, E, F are respectively reference numerals 83, 84, 85, 86. Pages 87, 88, 89 are the total pages respectively for each of teh #1 letters C, D, E; and some of the pages 90, 91 are shown for #1 letters B and F respectively. Diagonal lines 92, 93, 94 show the underlap of the #2 and #3 letter boxes for the respective #1 letters C, D, E.

Variations in the invention shown in relation to FIG. 1 such as differentiation in #2 from #3 designations and any of the repeated designations also apply to FIG. 4, so they need not be restated. Considering for the moment that in FIG. 4 the #1 letter is located with a thumb index, or with #1 letter line segments at the bottom of the dictionary, let us turn our attention directly to the locating of the #2 letter in FIG. 4. It is preferable in FIG. 4 to use "extended multiple listing" for the #2 and #3 letter boxes.

In extended multiple listing for whatever chart category the repeated boxes always end at the end of that category's #2 letter's pages. Referring to subcategory 81 for #2, #3 letters E-r, this is the last #3 subcategory here of #2 letter E, with the next #2 letter in the chart here after E being H. Respective boxes 95 for #1, #2, #3 letters C-E-r are not repeated into any pages of #1, #2 letters C-F with extended multiple listing. Even though #2 letter F is deleted from column 79, with extended multiple listing it is known where #2 letter F begins within for instance the pages 87 of the dictionary for #1 letter C—namely directly after #3 boxes 95 for C-E-r.

#2 letter boxes 96 for #1, #2 letters C-H are the next boxes in diagonal line 92 after boxes 95 for C-E-r. With #2 letter G also being deleted, a person finds where in the dictionary the #2 letter G begins where there is extended multiple listing by looking in the dictionary directly before #2 letter boxes 96 for C-H. While these two preceding examples show how to find the #1, #2 letters C-F and C-G, there are few words that begin with such two letters, though the same principle applies to whatever is the #1 letter. If the #1 letter were an "E" or "O", a person would find with these same #2 letters F and G more E-F, E-G's or O-F, O-G's in the dictionary.

With extended multiple listing the pages in the dictionary for any deleted #2 letter from column 79 can still be found by looking directly after a preceding box or directly before a following box if nowhere are more than two #2 letters deleted in a row.

Apart from thumb indexing and line segments on the bottom, the beginning of each #1 letter in the dictionary may still be located with #1 letter marks when there is abbreviation of #2 letters. Being that both #1 letters C and E are listed in column 79, it is determined that both C and E are to have the same kind of #1 letter mark. #1 letter marks 97 and 98 are for #1 letters C and E respectively, and are the same type as #1 letter box 29 with circle 30. Being that #1-#2 letter D is deleted from column 79, it is determined that #1 letter D shall have a different type of #1 letter mark. Here #1 letter D is located with #1 letter mark 99, which is the same type as #1 letter box 27 with cross 28. With the user knowing there is to be a different type of #1 letter mark for #1 letters in column 79 as for deleted #1-#2 letters, the user seeing three #1 letter marks 97, 98, 99 approximately across from #1 letters C and E in column 79, and two of these #1 letter marks being the same type, the user will be able readily to determine which of these #1 letter marks locates #1 letters C, D, and E. The #1 letter mark for any deleted #1-#2 letter is approximately across from between alphabetically adjacent #1-#2 letters existing in the chart.

The inclusion of #1 letter marks for #1 letters that have been deleted from the chart is called "inclusion of #1 letter marks for deleted #1 letters."

The #1 letter marks for all the 26 #1 letters in the dictionary in FIG. 4 are shown in FIG. 5, including #1 letter marks for deleted #1 letters, with there being a differentiation between #1 letter marks for deleted and included #1 letters. Chart 101 has only the #1-#2 letters, the #3 letters not being included here as at this step in locating a word the user is not yet concerned with #3 letters. FIG. 5 is a condensed and simplified drawing from the type shown in FIG. 4, with circles, such as #1 letter marks 102 and 103, representing the type of #1 letter marks 97 and 98 respectively; and a rectangle such as #1 letter mark 104 represents the type of #1 letter mark 99. FIG. 5 shows the approximate spacing of #1 letter marks, utilizing the concept of expanded vertical spacing for #1 letter marks, in addition to the concept of inclusion of #1 letter marks for deleted #1 letters.

Another alternative is to have "noninclusion of #1 letter marks for deleted #1 letters," and to have a #1 letter mark only for #1 letters in the chart. The condensed and simplified drawing of FIG. 6 illustrates noninclusion of #1 letter marks for deleted #1 letters, as applied to FIG. 4. Once again chart 105 shows only the #1 letters, and here #1 letter marks 106 and 107 represent the same type of #1 letter marks as #1 letter marks 97 and 98 in FIG. 4. Once again expanded vertical spacing for #1 letter marks is used. The way a person locates the start of a #1 letter here which letter has been deleted from the chart 105 is the same way a person would do so with thumb indexing where a single thumb index applies to more than one letter: the person would open the dictionary to the #1 letter mark for whichever #1 letter in the chart 105 most closely precedes the #1 letter he wants, and then depending on how many letters his desired letter follows this preceding letter, deal with the diagonal line of #2 and #3 letter boxes that far following the first diagonal line he opened the dictionary to.

If #1 letter marks are the means being used to locate #1 letters, and a #1 letter mark is not included for a particular #1 letter a person is looking up, and in addition his #1 letter is not treated with a diagonal line for reason of few pages in his #1 letter, the person locates his #1 letter by finding the diagonal line for the #1 letter directly preceding his #1 letter and looking directly after where that preceding diagonal line ends—or looking before the diagonal line for the #1 letter that follows his #1 letter.

An advantage of noninclusion of #1 letter marks for deleted #1 letters is reducing printed material on the length edge of a dictionary for possibly less confusion, and also less expense. An advantage of inclusion of #1 letter marks for deleted #1 letters is more direct identification of where any #1 letter begins.

The whole subject of inclusion or noninclusion of #1 letter marks for deleted #1 letters can be dispensed with by adding another column in a chart listing each #1 letter. Listing the 26 #1 letters in a separate column would no longer have the same letter refer to a #1 letter as to a #2 letter, reducing some complexity for some people, and also no longer have the subject of deleted #1 letters to deal with. Each #1 letter would be displayed, and a #1 letter mark could be placed approximately across from it. The chart could still have its abbreviation of #2 letters, with whatever #3 letters included in the chart. But the inventor does not prefer this alternative, for the reason of its requiring an additional column.

ALTERNATIVE TO OPEN DICTIONARY TO #1, #2, #3 LETTER IN ONE MOVEMENT.

It is difficult to open the dictionary to #1, #2, #3 letter in one opening with the preceding alternatives. Looking in FIG. 4 at the length edge 77 with the dictionary closed, a person can make out where his #1 letter begins whether he wants to arrive at the start of his #2 and possibly #3 letter in one opening or two openings. But with the dictionary closed, to open in one movement all the way to his #1, #2, and possibly #3 letter would consist of first finding the #1 letter mark and the appropriate adjacent diagonal line, then looking at the chart to find one's #2 and possibly #3 letter, and then looking across at the particular diagonal line to find his #2 and possibly #3 letter designation. A #2 and possibly #3 letter box for that word may be six or more inches away from his #1 letter mark, and the person trying to view along the appropriate diagonal line of #2 and #3 letter boxes will tend to let his attention slip to a neighboring diagonal line, their looking quite similar. Some of the diagonal lines of #2 and #3 boxes are fairly close to each other, sometimes 1/8 inch or less. The difficulty in finding the appropriate #2 and possibly #3 letter box consists mainly in holding one's attention to the correct diagonal line with an acceptable strain in doing so. The fact of there being no underlap for the #2 and #3 boxes with the book closed can be rather made up with printing #2 and #3 boxes on the very edges of the pages with whatever means, and by repeating boxes with for instance strict multiple listing or extended multiple listing.

To facilitate holding one's attention to the correct diagonal line, the pages of each #1 letter should be differentiated from the pages of each other #1 letter by the use of different colors. This is referred to as "color coding #1 letter page edges." In FIG. 4 signifying differentiated colors on length page edges of each of the #1 letters B, C, D, E, F are sets of two marks about ¾ down the #1 letters' pages of 45 degree increased angles—specifically //, ⌐¬, \\, ||, ⌿ respectively. The length page edges of each #1 letter can all be a particular color. For instance in FIG. 4 all the length page edges of pages 90, 87, 88, 89, 91 can be respectively a light shade of the colors green, red, orange, yellow, green. With this "color coding of all #1 letter page edges" and a person knowing he is dealing with a diagonal line of #2 and #3 boxes going through #1 letter length page edges that are for instance orange, the person will have quite reduced cause to stray to neighboring pages that are another color. With such a color coding it is feasible to open a dictionary with one opening to one's #1, #2, and possibly #3 letter.

While it can be sufficient for a color for each #1 letter's pages merely be different from the color for the next #1 letter's pages that follow in said dictionary, it is preferable that colors be repeated successively. For instance, as part of the above example shows, the colors can be red, orange, yellow, green, and then start over again red, orange, yellow, green. On the matter of how many different colors, too few colors can give the problem of the person's particular color for his #1 letter may be repeated too close in another #1 letter's pages, and the person slip his attention to that other #1 letter's pages. If there are too many colors, it becomes harder for a person to remember immediately the successive order of different colors, which is important especially if abbreviation of #2 letters is being used, as will shortly be related. Three, four, or five different colors successively repeated are satisfactory numbers, with four different colors being preferable to the inventor.

A less expensive and less effective alternative is to have just the first approximately five pages of each #1 letter a different color, with an alternative of just each first page being colored with each first page extra thick. With this "color coding first pages of #1 letter page edges," first pages 83, 84, 85, 86 of #1 letters C, D, E, F respectively may be red, orange, yellow, green, respectively, with the first pages of #1 letter B also green. With this alternative the person needs to keep in mind his diagonal line is the one following or preceding a particular color going down the length page edge(s) of some page(s).

Having in the chart a rectangular space 109 in the color red enclosing #1-#2 letter C helps preinform a person's attention to be ready to deal with #1 letter C's length page edges being red, so that coloring a rectangular space around any #1-#2 letter in the chart the same color as the length page edges for the respective #1 letter serves a value. This is called "colored rectangular spaces."

For color coding of all #1 letter page edges it is preferable for each rectangular space to be filled in with the respective light color; and for color coding first pages of #1 letter page edges, it is preferable for each rectangular space to be outlined with the likely more intense color that is found on the respective length page edge(s).

If all 26 #1-#2 letters are shown in the chart, the colored rectangular spaces using the four colors red, orange, yellow, green will continue in that repeated successive order in the chart, for instance: A, yellow; B, Green; C, red; D, orange; E, yellow; F, green; G, red; H, orange. But with abbreviation of #2 letters, some of the letters will be deleted, so that in FIG. 4 there being rectangular spaces 110, 109, 111, 112 enclosing respective #1-#2 letters A, C, E, H—by applying the same color to each letter as in the above, the respective color of each such rectangular space is yellow, red, yellow, orange.

With rectangular space 109 for #1-#2 letter C being red, and with a person knowing his order of colors is red, orange, yellow, green in this example, by looking at the successive order of colors on the length page edges even if the color orange is not shown for #1-#2 letter D in column 79, the person can easily conclude D is orange. The dictionary pages successively repeat all the colors, showing the successive order of all the colors, even though the colored rectangular spaces may be missing a few colors due to deletion of some #1-#2 letters.

If there were six colors successively repeated, a person might not so quickly interpolate any colors missing in the chart, though there is something to be said for having all six colors be red, orange, yellow, green, blue, purple of the spectrum and then purple be followed by red a not distant color—so as to provide another sense of continuity. Whatever is the number of colors and whatever is the successive order of colors, another alternative is to have all of the colors successively repeated in the chart even with abbreviation of #2 letters, by for instance in the chart having a thin silver 114 of the color orange between the rectangular spaces 109, 111 for C and E respectively—and having a thin silver of the respective color between adjacent #1-#2 letters in the chart for any deleted #1-#2 letter.

A colored rectangular space is not shown in FIG. 4 for each of its #1-#2 letters as the rectangular spaces 110, 109, 111, 112 provide examples of this idea: though the color of the remaining #1-#2 letters' rectangular spaces in column 79 with the preceding successive order of four colors red, orange, yellow, green is: I, yellow, L, orange; N, green; O, red; P, orange; R, green; T, orange; U, yellow; W, red; Y, yellow.

It is not necessary and is more expensive to have colored rectangular spaces in addition to color coding of #1 letter page edge as a person can determine what the particular color of any #1 letter's length page edges are by looking across to a #1 letter mark to see the adjacent color; but having colored rectangular spaces preinforming a person to any particular color will make opening a dictionary with one opening to a #1, #2, and possibly #3 letter easier.

Color coding of #1 letter page edges has another value if some #1 letter pages are not so treated with #2 boxes with or without #3 boxes, that those #1 letter pages not so treated are further identified due to this color differentiation. If in addition to diagonal line of #2 boxes with or without #3 boxes, there is no #1 letter mark for a deleted #1-#2 letter, or if the #1 letter desired is not on a separate thumb indexing—apart from looking before or after a following or preceding diagonal line respectively—a color coding will help to locate such #1 letters.

Though having the option to use this color coding to open the dictionary in one opening to the #2 and possibly #3 letter box, some people may choose especially with thumb indexing or tabs for #1 letters, first to open to the beginning of the #1 letter, and then to open to the #2 and possibly #3 letter box, in two openings—choosing for themselves personally a disadvantage of more time to arrive at the word, but acquiring for themselves personally an advantage of less mental particularity, even with this color coding, of not having to distinguish one's desired diagonal line from the other diagonal lines. With the locating of the beginning of any #1 letter being the use of the more economical #1 letter boxes with or without transverse aligners, the person would tend more readily to use the color coding to help him open the dictionary to his #2 and possibly #3 letter in one opening.

ALTERNATIVE OF CHART LOCATED ON LENGTH PAGE EDGES.

On some paperback dictionaries including telephone directories, a suitable alternative is to have the chart be located on length page edges. This avoids the need for a ledge extending the paperback cover, which ledge could be relatively fragile and become worn fairly quickly, besides posing a risk of giving the user paper cuts.

The chart may be printed, for instance rubber stamped, preferably on length edge pages towards the back of the dictionary. In FIG. 3 back pages 117 is a good location to print the chart. This chart should be printed in a different color from any boxes, as this chart may need partially to be printed over some diagonal lines of #2 and #3 boxes.

Figure 4A:
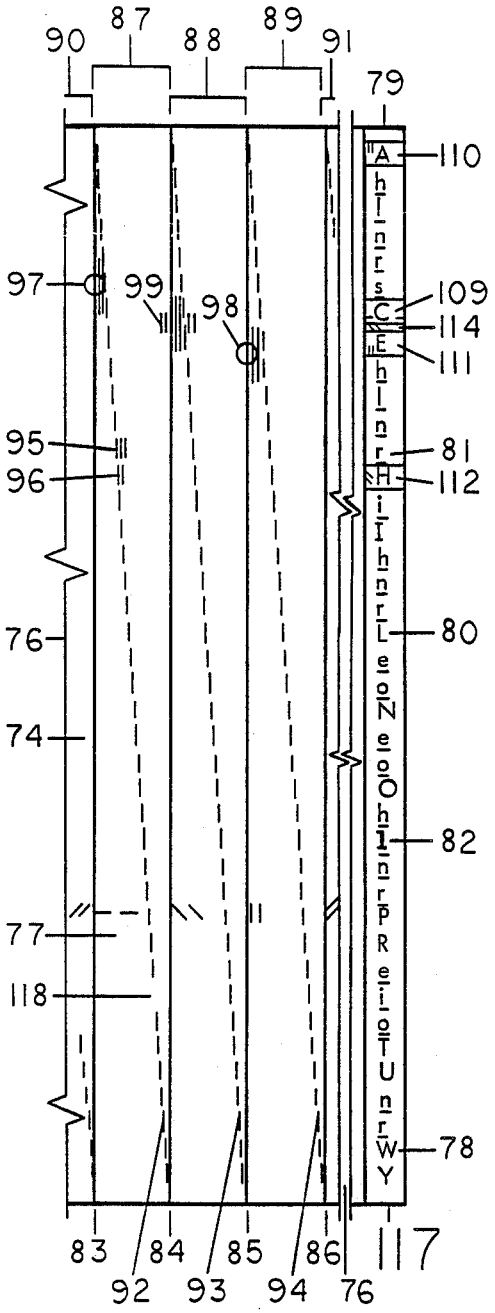
FIG. 4A is a side view of a paperback dictionary's length page edges, with chart printed on page edges towards the back of the dictionary.

As to how this index would look in practice, FIG. 4A shows that, with FIG. 4A being a side view of a dictionary's length page edges, with the break-out section again being basically for the pages in the dictionary for #1 letters C, D, E; with the chart in this case being printed upon page edges 117 towards the back of the dictionary, such pages following in this drawing the pages of the dictionary for definitions. Some telephone directories have a significant amount of supplemental material, for instance maps and dialing information; and with this supplemental material located on pages towards the back, this would reduce and possibly remove the chart being printed over diagonal lines. A disadvantage of a chart being printed on pages towards the back is that such printed letters could tend not to be as legible to read as on a ledge.

An advantage of applying this alternative to hardback dictionaries is that with a total of two columns in the chart, one column may be printed on length page edges towards the back of the dictionary, thereby not needing to increase the width of a ledge on a regular dictionary to accommodate two columns. With a hardback dictionary's positioning its supplemental material such as appendixes, some introductions, special articles, usage notes, etc. on pages towards the back of the dictionary, which supplemental material often results in a thickness of pages of 3/16 of an inch or so, this would reduce and possibly remove the chart being printed over diagonal lines. Another advantage as applied to hardback dictionaries is that it can be more economical to print all of the chart on length page edges than to print on a ledge or to print on a strip and adhere that strip to the ledge, though printing all of the chart on length page edges in hardback dictionaries is not a preferred embodiment. Having the chart on length page edges towards the back can include the color coding, where preferably if colored rectangular spaces are also used, any rectangular space is outlined in the respective more intense color, with the length page edges to all have the respective light color, this difference in intense and light coloring especially helpful if the chart overlaps on some diagonal lines.

DETERMINATION OF HOW MANY AND WHICH #3 LETTERS, AND WHICH #2 LETTERS SHALL BE INCLUDED IN THE ABBREVIATION OF #2 LETTERS.

FIG. 7 is a table that presents approximately how many pages in a 1979 *American Heritage Dictionary* each #2 letter covers. The acquiring of these figures consisted of going through the pages of each #1 letter separately and listing how many pages there are of each of the 26 #2 letters. Then the total was taken of the pages of each #2 letter for all of the 26 #1 letters, which provides the statistics in FIG. 7.

Notice in FIG. 7 for instance that the number of pages of #2 letters D and S, respectively 9.75 and 17.1, are relatively small compared to the predominance of how many pages of #1 letters for each of those letters in most English dictionaries, demonstrating that a person should not presume that a relative predominance of a letter as a #1 letter relates to the relative predominance of that letter as a #2 letter, and demonstrating that this separate computation of pages of #2 letters needs to be performed.

The total pages of #2 letters A, E, H, I, L, N, O, R, U are about eighty-five percent of the pages for all the #2 letters. Some of the #2 letters, such as B, D, F, G, J, K, Q, V, W, X, Z, had relatively few pages.

The #2 letters that are the main candidates to have #3 letter subcategories are these A, E, H, I, L, N, O, R, U. FIG. 8 is a table that presents proportionately how many #3 letters each of these #2 letters is to have depending on how many #3 letters A is to have. For instance, with A=5, being that there are 246.3 pages of #2 letter A, this means that dividing this 246.3 by this 5, we have the result of one #3 letter for each 49.26 pages of a #2 letter. Dividing this 46.26 into the total pages of #2 letter E, 209.6, this means that #2 letter E rates 4.25 #3 letters, or approximately 4 #3 letters. Dividing this 49.26 into the total pages of each of the remaining "main #2 letter categories" H, I, L, N, O, R, U—we arrive at the remaining numbers in that row in FIG. 8, namely 1; 3; 1 or 2; 1 or 2; 4; 3 or 2; 2 respectively. So in using FIG. 8, a person looks at the first column to see six alternatives (1 to 6) of how many subcategories #2 letter A is to have. Once a person has decided how many #3 letter subcategories for #2 letter A, he looks across that row to see how many #3 letters there are to be for each of the other main #2 letter categories.

A #2 letter that is calculated to merit for instance 2.53 #3 letters may be listed as 3 or 2, as was the case with the #2 letter R in FIG. 8 where A=5. Besides the matter of which way to round off a number, I also totaled the #2 pages in a 1938 *Funk & Wagnalls New Comprehensive Standard School Dictionary,* which gave me slightly different numbers; for instance for #2 letter R where #2 letter A=5 the number was 2.8. So I determined for this R that 3 has an edge over 2, so that the 3 was placed first here in "3 or 2."

The first conclusion, apart from a question of how many #3 letters are to be applied to #2 letter A, is that the number of #3 letters for each #2 letter in the chart is approximately proportional to the number of pages in any dictionary having each #2 letter. Some of the chart #2 letters may have so few pages that they may be accorded zero #3 letters.

Depending on the dictionary, a person may want for instance 6, 5, 4, 3, 2, or 1 #3 letter subcategories for #2 letter A based upon different considerations, including length of the dictionary's pages, how small the type in the chart is to be, completeness, lack of complexity which may favor fewer #3 letters, and how many pages there are in a dictionary. Notice that in FIGS. 1 and 4 that the relative number of #3 letter subcategories conforms to FIG. 8—in FIG. 1 #2 letter A having "3" and in FIG. 4 #2 letter A having "5."

FIG. 8 providing how many #3 letter subcategories there are to be in basically whatever instance, once the person has decided how many #3 letters he wants for #2 letter A, the next matter to be determined is what the particular #3 letters are to be.

If the #2 letter is a consonant, either H, L, N, or R, and if there is to be one #3 letter subcategory, that #3 letter is "i." "I" is the vowel in the middle of the five vowels a, e, i, o, u, and "i" is very often centered in the middle of any #2 letter consonant's pages. For a consonant #2 letter, if there are to be two #3 letter subcategories, the #3 letters are "e" and "o." For a consonant #2 letter, three #3 letter subcategories are "e, i, o" preferably, with "e, i, u" and "e, o, u" also being possibilities. There is little advantage in having a #2 letter consonant with a #3 letter subcategory be "a" as a person already knows "a" will follow the #2 letter directly. The main value for a set of three #3 letters to include "u" is if there is abbreciation of #2 letters and extended multiple listing, so that there will not be quite so many pages of boxes or whatever designation for this last #3 letter. Accordingly, for a consonant #2 letter, if three #3 letters are desired, they are "e" and two later vowels, which includes the possibilities have of "e, i, o"; "e, i, u"; and "e, o, u"—w and y not being included here as vowels considered.

The emphasis here is not on the printing per se of whatever letters in the chart, but the subject of letters needs to be taken up so as to determine where the designations on length page edges are to be located, in the physical dividing up of the dictionary into different compartments for the quicker loading of words. The structural matter of which compartments has some relevance in the successful operation of this invention.

It is a more detailed matter to determine what the #3 letters are to be for any #2 letter that is a vowel. As an example, let us consider the situation where a person wants 5 #3 letter subcategories for vowel #2 letter A. The inventor's procedure is as follows: a person might investigate #1 letter B as a start, and find that in this 1979 *American Heritage Dictionary* there are about 19 pages of #1, #2 letters B-A. Wanting 5 subcategories, he would divide this 19 pages by that number 5 plus one, or 6. 19 divided by 6 gives 3.17, telling him that every 3.17 pages from the start of the B-A's, he is to see what the #3 letter is in that location. In this dictionary the first page of #1–#2 letters B-A is page 95, so by repeatedly adding this 3.17, we get division points of approximately 98.2, 101.3, 104.5, 107.7, and 110.9. In this dictionary he would find that the #3 letters at these divisions points are c l n r s. Repeating this mathematical procedure for other #1 letters with the #2 letter A, he would arrive likely at other sets of #3 letters, so that finally he takes all these sets of #3 letters, each having the specific desired number of #3 letters, and comparing them together, decides upon approximately an average set. The inventor chose f l n r s, which is what we listed in FIG. 9 for where A=5.

FIG. 9 is a table showing empirically approximately the most often found #3 letters when each of the #2 letter vowels listed to the left of the table is to have the humber of #3 letter subcategories shown across the top of the table.

The just preceding computation involves just a specific vowel where just a specific number of #3 letters is desired. If another specific number of #3 letters is desired, the computation must be repeated for that other number (plus one—to get the proper divider); and the computation must also be repeated for each other vowel with each other number of desired #3 letters. The twenty-three entries in FIG. 9 involved twenty-three separate computations, with these twenty-three entries each being an approximation the inventor decided on.

In FIG. 4 the five subcategories of #3 letters for #2 letter A are h l n r s. The inventor prefers that where up to four #3 letters are to be chosen for a #2 letter vowel, that these #3 letters are to be chosen only from among the approximations h l n r, as it is that these same letters are the predominant consonants as #2 letters, which letters are to have their own #3 letter subcategories. In the inventor's view, it is easier for a person to learn these letters as #3 letters, being that he is already using them as a predominant and well recognized #2 letters.

In FIG. 9 while f l n r s is empirically approximately indicated for 5 subcategories of #2 letter A, in FIG. 4 where A is to have 5 subcategories the f here has been substituted with an h, h being close by. Likewise in FIG. 1 and in FIG. 4, should the reader note the number of #3 letter subcategories for any #2 letter vowel, the reader will note that seldom are the particular #3 letters shown the same as shown in FIG. 9, as it is that approximations have been made in FIGS. 1 and 4 using h l n r.

Notice that looking down any column in FIG. 9 where the same number of #3 letters are desired for whatever vowel #2 letter, that there is a significant similarity, with l, n, and r being quite common, with any of d, e, f, g, i often being the first letter when three or more #3 letters are desired. According to one approximation, "h" is not that far an approximation from d, e, f, g, i.

An alternative is to use precisely the letters shown in FIG. 9, which would mean more precise, proportionate divisions of dictionary pages into #3 letter compartments, but which would also mean a user having to learn different #3 letter subcategories for his vowel #2 letters.

There are other ways to determine sets of #3 letters for #2 letter vowels. However it is done, as a start, depending on what number of #3 letters #2 letter A is to have, from FIG. 8 a person knows the number of letters in each set of #3 letters for each other #2 letter vowel. Then looking up the respective number for each #2 letter vowel in FIG. 9, the person sees the empirical choices of #3 letter sets.

The person may take those #3 letter sets for all the #2 letter vowels from FIG. 9 and average them such that there are fewer different letters in the #3 letter sets. This is the "average rule." For instance, referring to FIG. 8 where #2 letter vowel=5, the sets for #2 letter vowels A, E, I, O, U have these respective number of #3 letters: 5, 4, 3, 4, 2. From FIG. 9 the indicated letters in these respective sets are: f l n r s, d l n r, g n r, l n r u, l r. These sets may be averaged to the respective sets:

f l n r t, f l n r, f n r, l n r t, l r. This would facilitate learning the different #3 letter sets as compared to using sets direct from FIG. 9 though not as easy to learn as using h l n r approximations, though providing more precise compartments than using h l n r.

Another means to determine sets of #3 letters is to choose #3 letters for #2 vowels E, I, O, U only from the #3 letters used for #3 letter vowel A, whether the letters in such #2 letter vowel include h l n r or not. Considering #3 sets for #2 letter vowels, whatever is the number of #3 letters in the largest #3 set for #2 letter vowel A, for any #3 set that has one #3 letter less, remove one letter from that largest set. then for any #3 set that has still one #3 letter less, remove another #3 letter. And so on. This results in a consistency that is fairly easy to remember for the different #3 sets, and this is called the "consistency rule." An example of the consistency rule is the #3 sets in FIG. 4, which for #2 letters A, E, I, O, U the #3 sets respectively are h l n r s, h l n r, h n r, h l n r, n r.

The #3 sets in FIG. 1 for #2 letter vowels are: h n r, h n r, l r, l n r, n. Here the consistency rule has not been applied.

It is important that this dictionary be easy enough to learn to use that people actually will use it, so that some loss in precision can be worthwhile if it results in enough more people using the dictionary more.

While a person will learn the letters in the #3 sets more quickly with some of the above means of determining them than with other means above, by whichever means he will still relatively quickly learn them, if only for the reason that this invention has relatively few categories. Once a person learns the letters in any #3 sets, he will tend not to need to re-read the letters in any #3 set, but by knowing them in advance, on finding his #2 letter in the chart, he can largely just note the length positoin of any mark for any #3 letter in the chart beneath that #2 letter and almost immediately look across to the diagonal line to pick out his #3 letter designation.

With FIG. 9 being a basis to help specify the particular #3 letters depending on how many #3 letters a person wants for any #2 letter vowel, the remaining matter to be determined for the alternative of abbreviation of #2 letters is which #2 letters are to be included in the chart.

FIG. 10 is a table, showing five different alternatives of what the #2 letters may be in abbreviation of #2 letters. Each alternative is numbered in the left hand column, from 1 to 5, and after each alternative number are all the #2 letters to be included in the chart.

Alternatives 1, 2, and 3 of FIG. 10 having following each main #2 letter category (A, E, H, I, L, N, O, R, U)—usually the next #2 letter is the letter that strictly alphabetically follows each such main #2 letter. Even though there are few pages for instance of #2 letter F in the dictionary, there is a #2 letter F in alternatives 1, 2, 3 following the #2 letter E and whatever #3 letters #2 letter E is to have. Some people will prefer having such a #2 letter F alphabetically following where there are any #3 letters for #2 letter E so as rather to impart a sense of "this is where that preceding #2 letter's subcategories end." Extended multiple listing shows where any #2 category ends, but some people will prefer the showing right in the chart where a #2 category ends by for them the more explicit showing of the next #2 letter. Such a showing where any #2 letters with subcategories end is especially helpful with single listing or strict multiple listing, which do not show such an "end."

Alternatives 4 and 5 in FIG. 10 usually do not show by themselves where any #2 letters with #3 letter subcategories end, and these alternatives 4 and 5 are basically intended to be used with extended multiple listing. Alternative 4 is shown in FIG. 4.

Here is a list of the thirteen most predominant #2 letters in FIG. 7 from highest to lowest: A, E, O, I, R, U, N, L, H, T, P, Y, C. All of these #2 letters are in this alternative 4 in FIG. 10, with the only other letter in alternative 4 being W.

Alternative 5 in FIG. 10 has the minimum #2 letters a chart can have and still have the nine most predominant #2 letters A, E, H, I, L, N, O, R, U and have no more than two deleted letters between any two #2 letters in the chart. The only letters added to these nine letters in alternative 5 are the letters C and X, so as to prevent there being any deletion of three successive #2 letters. It is rather fortuitious that the English language is such that these predominant #2 letters are spread apart so evenly in the alphabet so as to make possible such an abbreviation.

For languages other than English the computations in FIGS. 7, 8, 9, 10 should be repeated as chart categories may differ, along therefore with respective designations on length page edges.

An advantage of having a larger number of #2 letters in the chart, if not all of them, is that it is easier for a new person to learn how to use this dictionary index. If a new person knew that the #2 letters B, D, F, G, J, K, Q, V, W, X, Z—comprising 11/26 or 42 percent of the #2 letters in the dictionary, only had about 3.9 percent of the #2 pages of the dictionary, that new person might agree there is little value in these #2 letters being included in the chart. Still, there is the disadvantage of deleted #2 letters being an extra aspect of complexity to have to deal with when the person is learning at the very outset.

Therefore, FIGS. 7, 8, 9 show the mathematics of choosing the approximate #3 letters in the chart; and FIGS. 7 and 10 show what #2 letters approximately shall be included in the abbreviation of #2 letters. The choice of letters in the categories is largely based upon what is found empirically in the dictionary pages, so that the letters reflect the structure of the dictionary as shown in the compartments of designations. For abbreviation of #2 letters in FIG. 10 the means to locate where any #1 letter begins in a dictionary is with thumb indexing, line segments at the bottom of the dictionary, "inclusion of #1 letter marks for delted #1 letters," or "noninclusion of #1 letter marks for deleted #1 letters."

ECONOMIZING ON #2 AND #3 DESIGNATIONS AND OTHER CONSIDERATIONS.

There can be economizing in this dictionary index such that there is not a designation for each of the categories in the chart for each #1 letter so treated. This economizing would tend more likely to be applied to small paperback dictionaries, including small paperback thesauruses and small paperback telephone directories. A disadvantage in having fewer designations is having a somewhat higher level of confusion in not having continuous diagonal lines, and an advantage in having fewer designations is having the reduced cost of applying fewer designations to the length page edges.

"Total designations" is defined to be a designation for each category in the chart for each #1 letter so treated. "Reduced designations" is having fewer designations than total designations. Reduced designations can include not having more than one designation on a length page edge, so that where more than one category in the chart appears on a set of open pages, having a designation only for the first category on that set of open pages. (According to single listing, for no more than one designation per page, if a designation for the same #1 letter's pages for the same category was already on a preceding page, then the designation on that set of open pages would be for the second category in the chart appearing on that set of open pages.) Reduced designations can include no designations for categories that do not have words in the dictionary. Reduced designations can include not having for any #1 letter any designation whose category has relatively few words in the dictionary, but instead, for any #1 letter, having designations only for its categories relatively more prevalent in words. According to this latter reduced designations, differing designations may be applied to different #1 letters, depenging on respective categories' differing prevalences in words. The inventor prefers total designations.

"#1 letters so treated" is defined to mean a diagonal line of #2 designations being applied to some #1 letters but not necessarily to all of the #1 letters. It is not presumed that a #1 letter so treated has designations for any #3 letters, though designations for #3 letters may also be applied.

As an other consideration as to location of designations on length page edges, there would still be some value if a designation was located only approximately where its respective category was to be found in a dictionary, and only approximately across from its respective category in the chart; but it is preferable for a designation to be located within the pages of a #1 letter where the respective category in the chart is to be found, and also directly across from the respective category in the chart.

Some minimums may be placed as to the most economizing that may be used with this invention. The #1 letters so treated shall constitute a plurality of the #1 letters, if not at least a minimum of six #1 letters. With a small dictionary's having relatively fewer pages per #1 letter, it may be decided that it is adequate to have fewer #1 letters so treated.

As to a minimum number of #2 designations, whatever is the number of #2 letter categories in the chart, there shall be at least twice that number of #2 designations on the length page edges of the dictionary. Any #3 designations would be designations in addition to this minimum number of #2 designations. It may be stipulated that a minimum number of #3 designations is at least twice the number of #3 letter categories in the chart. The minimum number of designations may instead be said to be at least twice the number of categories in the chart. It may be stipulated that each of at least two #1 letters has: at least one-third as many #2 designations as there are #2 letters in the chart, and possibly in addition at least one-third as many #3 designations as there are #3 letters in the chart; or at least one-third as many designations as there are letter categories in the chart. Any repeated designtions are not considered to be computed in any of these minimums; and any minimum applies whatever is the distribution of designations among #1 letters so treated, it not being presumed that the same designations are to be seen in each #1 letter so treated. It is understood that a larger number of designations may be specified than any of these minimums to add to the value of more precisely locating words.

Considering a dictionary open to the start of #1 letter B, if no designation for #2 letter L was applied to #1 letter B, but a designation for #2 letter L was applied to #1 letter C, and the next designation for #1 letter B was for #2 letter N, there would be the situation of the next designation in the dictionary for #2 letter L being for a later #1 letter. A person using such index would need to keep in mind how far back from the top of the open pages any designation was so as not to pick another designation, for instance not pick this designation for #1, #2 letters C-L if he would have wanted a designation for #1, #2 letters B-L. The person also has the diagonal line nature of the designations, wherein he could also rather see if any designation was within the diagonal line of his #1 letter, for instance rather seeing that the designation for #1, #2 letters C-L was not along the diagonal line for #1 letter B. Not having a designation in a diagonal line when there is a category in the chart that would have allowed for such a designation, results in a hole in that diagonal line so that that diagonal line is not "continuous." Hole 118 in FIG. 4 is an example of reduced designations, a designation for #1, #2, #3 letters C-R-i not being included in diagonal line 92, when at the same time #1 letter C is being so treated, and there is in chart 78 #2 letter R, and as a subcategory to #2 letter R there is #3 letter i.

Even with economizing, this invention still retains among other basic values the value of each of more than one #2 and possibly #3 letter categories in the chart having a designation for more than one #1 letter, these designations arranged in diagonal lines, even if not continuous diagonal lines.

STRUCTURAL DIFFERENCES RELATING TO CHART

Prior art does not have in a chart a column of #2 letters one letter wide structurally coordinated with #2 designations. Prior art does not have in a chart a single column one letter wide—or two columns each of which is one letter wide—of #2 and #3 letters structurally coordinated with #2 and #3 designations, respectively. Prior art does not have #2 letter marks and #2 designations structurally coordinated with a single column one letter wide of #1–#2 letters in a chart. In each of these respects this invention provides for a structural economy and a convenience relating to the width of the material of the book that is to be used for a chart.

"Structurally coordinated" may be defined to be approximately across from a #2 designation or a #3 designation or a #1 letter mark there is a respective letter in the chart, the #2 designation or #3 designation or #1 letter mark being located on a length page edge of such dictionary where an entry of such a respective letter in the chart is to be found. Chart letters may be said to be structurally coordinated with designations or #1 letter marks; or designations or #1 letter marks may be said to be structurally coordinated with chart letters.

Having two columns in this invention differs from having two columns in prior art in different ways. For instance, two columns in this invention for #2 and #3 letters are in one alphabetical succession, meaning that any category that is closer to the bottom of the dictionary is alphabetically later than any category that is closer to the top of the dictionary, considering any category in the two columns the way designations are arranged respectively; whereas in prior art having two columns each column alphabetized in that arrengement, the top category in the second column usually alphabetically follows the bottom category in the first column. Closer to the start of the alphabet is considered "earlier" in the alphabet, and closer to the end of the alphabet is considered "later" in the alphabet. In this invention having two columns, one for #2 letters and one for #3 letters, wherever there is one category at a certain length level, there is no category in the other column at the same length level—whereas in prior art if there are two columns, there are often two categories side by side.

CONCLUSION, RAMIFICATIONS AND SCOPE OF INVENTION

This is a dictionary index, dealing with indexing entries according to the alphabetization of letters. This index is not oriented to handling the indexing of numbers or subjects, which latter indexing involves different considerations and different structural requirements.

Different alternatives in this invention are provided to serve different purposes and preferences. The different alternatives largely involve different manufacturing that is to be applied to length page edges, the different alternatives relating to different expenses of such manufacturing so that there is the decision of what level of expense to meet to provide what level of value. The least expensive manufacturing involves all the #2 and #3 letter boxes and also #1 letter marks printed on the length page edges be in the color black, such being printed at the same time the main copy on the faces of the pages is printed. Some greater expense is involved related to #2 and #3 letter boxes by differentiating them from each other by different length of boxes and/or different color. Some greater expense is also involved relating to #2 and #3 letter boxes by going beyond a single listing, into repeating boxes on following pages, whether that repetition involves strict multiple listing or extended multiple listing with or without the add rule, which add rule can also involve the expense of printing the added boxes in a different color. As far as #1 letter boxes are concerned, progressively greater expense involves a transverse aligner being a mark of the same color, then being a mark in a different color, for instance red, then to either of the two preceding dealing with or without transverse aligners having a tab in addition. While this list does not present all the alternatives previously presented, also, different successive colors may be printed on the length page edges of different #1 letters, with or without a respective color differentiation also being provided in the chart.

While deciding on which alternative provides questions for the manufacturer, such questions will not affect a person using a completed dictionary index, such a person having only one embodiment before him, which will be reasonably easy to learn how to use, with likely a single page of directions included on the inside back cover.

Whichever embodiment the person using this dictionary index has, the embodiment will involve the basic parts of this invention: there is one set of categories in the chart of one or two columns, which one set of categories applies to every #1 letter so treated, and for each category there may be a designation for every #1 letter so treated. The total designations for all the #1 letters so treated is relatively large. With whatever means the person locates the beginning of his #1 letter, the locating of the #2 and possibly a #2 letter is constant—he looks directly across from the categories in the chart. And h the dictionary to that #2 or #3 designation and finds himself often no more than two or three pages from his desired word.

It may be that this index will later be titled the "Alexander Index."

Thus the reader will see that this dictionary index provides relatively few categories which can be fairly easily learned and memorized by the user, that this dictionary index can basically be applied to existing hardback and paperback dictionaries relatively inexpensively and that the finished product will be relatively convenient to handle by the user, and that the dictionary's pages are compartmentalized into a large number of designations so as more adequately to locate whatever words.

While my above description contains many specificities, these should not be construed as limitations on the scope of the invention, but rather as exemplifications of embodiments thereof. Many other variations are possible: for instance, instead of or in addition to differentiation of #2 and #3 boxes, utilizing alignment lines extending from chart categories across length page edges to #2 and #3 boxes. Accordingly, the scope of the invention should be determined not by the embodiments illustrated, but by the appended claims and their legal equivalents.

I claim:

1. A dictionary index comprising:

a book comprising a plurality of pages, said pages having exposed top, bottom and length edges, the contents of said book comprising an alphabetical listing of words;

the pages of said book being divided into a plurality of #1 letter categories, with the pages comprising each #1 letter category of said categories being further divided into a plurality of #2 letter categories, and with the pages comprising each of said #2 letter categories being further divided into a plurality of #3 letter categories;

a chart comprising a column of #2 letters in alphabetical order imprinted on a substrate, said #2 letters being chosen from the set of letters comprising said #2 letter categories with said substrate being affixed to said book such that said chart is visible when said book is closed and such that said chart is visually alignable to the length edges of the pages of said book;

first means for designating a set of pages comprising a #1 letter category, said means being associated with said book being adapted to allow a user to open said book to a page of a preselected #1 letter category;

second means to designate #2 letters, corresponding to at least some of the #2 letter categories, said second means being located on or near said length page edges and being visible when said book is closed, at least some of said second means being structurally coordinated with a #2 letter in said chart such that each said second means so coordinated is located generally across from its corresponding #2 letter in said chart, and such that said second means is located on a page within the pages of a preselected #1 letter category wherein the #2 letter category corresponding to the second means is to be found;

wherein there is more than one said second means structurally coordinated with at least one of said #2 letters in said chart, the more than one said second means structurally coordinated with a single #2 letter in said chart appearing in separate preselected #1 letter categories;

whereby when the book is opened to the first page of a preselected #1 letter category, said index indicates where to open said book to find a #2 letter category within the pages comprising the preselected #1 letter category, said index having fewer #2 letters in said chart than the number of second means designating said #2 letters.

2. The dictionary index in claim 1 wherein said #2 letters of said chart are in a single column.

3. The dictionary index in claim 1 wherein said book has a cover with a ledge, said ledge being defined to be that portion of the cover that extends past the length page edges of the pages, and said chart and said substrate are located on said ledge.

4. The dictionary index in claim 1 wherein said substrate is the very edges of said length page edges towards the back of said book, wherein sid #2 letters of said chart are imprinted on said very edges of said length page edges towards the back of said book.

5. The dictionary index in claim 1 also comprising:

said chart also comprising a column of #3 letters imprinted on said substrate, said #3 letters being subcategories of said #2 letters, said #3 letters being chosen from the set of letters comprising said #3 letter categories, said #3 letters of said chart being visible when said book is closed and visually alignable to the length edges of the pages of said book;

third means to designate #3 letters, corresponding to at least some of the #3 letter categories, said third means being located on or near said length page edges and being visible when said book is closed, at least some of said third means being structurally coordinated with a #3 letter in said charge such that each said third means so coordinated is located generally across from its corresponding #3 letter in said chart, and such that said third means is located on a page within the pages of a preselected #1 letter category and within the pages of a #2 letter category wherein the #3 letter category corresponding to the third means is to be found;

wherein there is more than one said third means structurally coordinated with at least one of said #3 letters in said chart, the more than one said third means structurally coordinated with a single #3 letter in said chart appearing in separate preselected #1 letter categories;

whereby when the book is opened to the first page of a preselected #1 letter category, said index indicates where to open said book to find a #2 letter category and a #3 letter category within the pages comprising the preselected #1 letter category.

6. The dictionary index in claim 5 wherein each said second means and each said third means is a #2 box and a #3 box respectively, printed on the length edge of pages.

7. The dictionary index in claim 5 wherein in said chart said #2 letters are in one column, and said #3 letters are in another column.

8. The dictionary index in claim 7 wherein said one column of said #2 letters is to the left of said another column of said #3 letters, and no said #2 letter is immediately to the left, crosswise, of any said #3 letter.

9. The dictionary index in claim 5 wherein in said chart said #2 letters and said #3 letters are in a single column.

10. The dictionary index in claim 5 wherein in said chart said #2 letters are in capitals and said #3 letters are in lower case.

11. The dictionary index in claim 5 wherein in said chart said #2 letters are in one color and said #3 letters are in another color.

12. The dictionary index in claim 5 wherein in said chart said #2 letters are in a kind of type and said #3 letters have a difference in its kind of type.

13. The dictionary index in claim 5 wherein there is a space along the length of length page edges: between any said second means and adjacent another said second means; between any said third means and adjacent another said third means; and between any said second means and adjacent said third means.

14. The dictionary index in claim 5 wherein the length along the length edge of a page of said second means is different than the length along the length edge of a page of said third means.

15. The dictionary index in claim 5 wherein said second means are of a different color than said third means.

16. The dictionary index in claim 5 wherein at least one said length page edge has more than one said second means, at least one another said length page edge has more than one said third means, and at least one yet another said length page edge has said second means and said third means.

17. The dictionary index in claim 5 wherein if corresponding to any said #2 letter in said chart there is no said #2 letter category in the pages of said book for said preselected #1 letter category, being that there is no alphabetical listing word in said book that has said #2 letter category as part of its spelling, it is considered that there is hypothetical alphabetical listing word in said book having said #2 letter category, and that said hypothetical alphabetical listing word is located on the particular page having actual words that would be alphabetically closest to said hypothetical alphabetical listing word, and said second means is placed upon such a particular page as if said hypothetical alphabetical listing word having said #2 letter category were in said book;

and if corresponding to any said #3 letter in said chart under a said #2 letter in said chart there is no said #3 letter category in the pages of said book for said preselected #1 letter category, said third means is placed upon such a page as if another hypothetical alphabetical listing word having said #3 letter category were in said book.

18. The dictionary index in claim 5 wherein single listing is applied, wherein a said second means is located only on the first page of however many pages there are in corresponding said #2 letter category, and wherein a said third means is located only on the first page of however many pages there are in corresponding said #3 letter category.

19. The dictionary index in claim 5 wherein strict multiple listing is applied, wherein a said second means is located on as many pages as there are within said corresponding #2 letter category that have the #3 letter category for the letter a, and wherein a said third means is located on all pages of said corresponding #3 letter category.

20. The dictionary index in claim 5 wherein extended multiple listing is applied, wherein a said second means is located on all pages within said corresponding #2 letter category from the first page of said corresponding

#2 letter category to the first page of any said #3 letter category that corresponds to the first #3 letter that is a subcategory of corresponding said #2 letter in said chart, so that if there is no #3 letter that is subcategory to corresponding said #2 letter in said chart, said second means is located on all pages within said corresponding #2 letter category;

and wherein a said third means is located on all pages within said corresponding #2 letter category from the first page of said corresponding #3 letter category to the first page of any following said #3 letter category that corresponds to any following #3 letter in said chart that is a subcategory of said #2 letter, so that if there is no said following #3 letter in said chart, said third means is located on all pages within said corresponding #2 letter category from the first page of said corresponding #3 letter category to the last page of said #2 letter category, each said third means being located across from its corresponding #3 letter in said chart.

21. The dictionary index in claim 18, 19, or 20 wherein the add rule is applied, and wherein there are successive sections of pages of said book, each of said sections composed of approximately the same number of pages;

wherein there are imprinted marks that are aded to any said second means as is necessary so as to arrive within each of said sections at a predetermined minimum total of said second means and said imprinted marks, said predetermined minimum total being the same or larger for any successive said section, any said imprinted marks being on directly following pages from said second means, any said imprinted marks being generally across from any said second means;

and wherein there are additional imprinted marks that are added to pages following said third means so that there is said predetermined minimum total of number of pages having said third means and additional imprinted marks, any said additional imprinted marks being on directly following pages from said third means, any said additional imprinted marks being generally across from said third means.

22. The dictionary index in claim 21 wherein said imprinted marks are colored differently from said second means and wherein said additional imprinted marks are colored differently from said third means.

23. The dictionary index in claim 5 wherein any #2 letter in said chart also refers to a #1 letter category, and approximately across from any #2 letter in said chart there is a #1 letter mark on the length page edge of at least the first page of the #1 letter category that such #2 letter also refers to.

24. The dictionary index in claim 23 wherein there is a transverse aligner comprising a mark located approximately across from said #2 letter in said chart and printed across said #1 letter mark, said transverse aligner being approximately the same length along the length edge of a page as the length along the length edge of a page of respective said #2 letter in said chart.

25. The dictionary index in claim 24 wherein said transverse aligner is printed on several pages before the first page of said #1 letter mark and on several pages after the last page of said #1 letter mark.

26. The dictionary index in claim 24 wherein said transverse aligner is printed in a different color than the color of said #1 letter mark.

27. The dictionary index in claim 23 wherein the #1 letter mark is a box printed on the length page edge of at least the first said page in addition to a tab on the first said page.

28. The dictionary index in claim 23 wherein at least one of the twenty-six letters in the alphabet are deleted from the #2 letters in said chart, and another #1 letter mark is provided for each such deleted #2 letter, said another #1 letter mark located approximately across from between alphabetically adjacent #2 letters existing in said chart and also on at least the first page of each #1 letter category whose #2 letter has been deleted from said chart.

29. the dictionary index in claim 5 wherein said book has a bottom, and there are identifications at said bottom of said book for most said #1 letter categories, an identification for any said #1 letter category located on pages of said #1 letter category, said identifications located approximately in the half of said book close to the length page edges, said identifications positioned in different oblique lines.

30. The dictionary index in claim 29 wherein said identifications comprise line segments on several first pages of most said #1 letter categories, with a letter label for each said #1 letter category identified printed adjacent each respective line segments.

31. The dictionary index in claim 5 wherein there is color coding of #1 letter category length page edges, comprising there being a specific color on some of the length page edges of each #1 letter category, a color for each #1 letter category's pages being different from the color for the next #1 letter category's pages that follow in said book.

32. The dictionary index in claim 31 wherein any #2 letter in said chart also refers to the #1 letter category's pages of the same letter, and there are colored rectangular spaces, comprising there being a colored space around each said #2 letter in said chart, the color of each said colored space being the same color as on said some of the length page edges of each respective #1 letter category.

33. The dictionary index in claim 32 wherein some of the twenty-six letters in the alphabet are deleted from the #2 letters in said chart, and for each such deleted #2 letter there is a silver of color in the chart between alphabetically adjacent #2 letters' said colored rectangular spaces, the color for any said silver being the same as on said some of the length page edges of its respective #1 letter category.

34. The dictionary index in claim 5 wherein in said chart the number of said #3 letters for each said #2 letter is approximately proportional to the total number of pages in said book having each said #2 letter.

35. The dictionary index in claim 34 wherein specific #3 letters for #2 letters that are consonants are chosen in the following fashion: if one #3 letter is desired, it is i; if two #3 letters are desired, they are e o; if three #3 letters are desired, they are e and two later vowels.

36. The dictionary index in claim 34 wherein given the specific number of #3 letters that is desired for any specific #2 letter vowel, the specific #3 letters are chosen in the following fashion: considering separately each #1 letter category, the pages of said specific #2 letter vowel shall be divided into said specific number of #3 letters plus one, and the #3 letters be noted at each division point; then this process is repeated for each other #1 letter category, and from the arrived at sets of #3 letters approximately an average set is decided upon.

37. The dictionary index in claim 36 wherein where up to four said #3 letters are to be chosen, they are to be chosen only from among the approximations h, l, n, r.

38. The dictionary index in claim 5 wherein whatever is the number of #3 letters in said chart, there is at least twice that number of third means on the length page edges of said book.

39. The dictionary index in claim 1 wherein there is abbreviation of #2 letters comprising some of the twenty-six letters in the alphabet are delted from being included in the #2 letters in said chart, with there being said second means on any length page edge for only each of the #2 letters in said chart.

40. The dictionary index in claim 39 wherein said abbreviation of #2 letters that are to be included in said chart are to be the most predominant #2 letters as per total pages of #2 letters in said book, with an additionof other #2 letters such that there are to be not more than two said deleted letters between any two #2 letters included in said chart.

41. The dictionary index in claim 1 wherein there is one said second means for each said #2 letter in sid chart for each said preselected #1 letter category.

42. The dictionary index in claim 1 wherein whatever is the number of #2 letters in said chart, there is at least twice that number of second means on the length page edges of said book.

43. A dictionary index comprising:

a book comprising a plurality of pages, said pages having exposed top, bottom and length edges, the contents of said book comprising an alphabetical listing of words;

the pages of said book being divided into a plurality of #1 letter categories, with the pages comprising each #1 letter category of said categories being further divided into a plurality of #2 letter categories, and with the pages comprising each of said #2 letter categories being further divided into a plurality of #3 letter categories;

a chart comprising a column of #2 letters in alphabetical order imprinted on a substrate, said #2 letters being chosen from the set of letters comprising said #2 letter categories with said substrate being affixed to said book such that said chart is visible when said book is closed and such that said chart is visually alignable to the length edges of the pages of said book, said chart having only one column of #2 letters, said one column being only one letter wide;

first means for designating a set of pages comprising a #1 letter category, said means being associated with said book being adapted to allow a user to open said book to a page of a preselected #1 letter category;

second means to designate #2 letters, corresponding to at least some of the #2 letter categories, said second means being located on or near said length page edges and being visible when said book is closed, at least some of said second means being structurally coordianted with a #2 letter in said chart such that each said second means so coordinated is located generally across from its corresponding #2 letter in said chart, and such that said second means is located on a page within the pages of a preselected #1 letter category wherein the #2 letter category corresponding to the second means is to be found;

wherein there is more than one said second means structurally coordinated with at least one of said #2 letters in said chart, the more than one said second means structurally coordinated with a single #2 letter in said chart appearing in separate preselected #1 letter categories;

whereby when the book is opened to the first page of a preselected #1 letter category, said index indicates where to open said book to find a #2 letter category within the pages comprising the preselected #1 letter category, said index having a chart that is narrow and covers relatively little area of said book.

44. The dictionary index in claim 43 also comprising:

said chart also comprising another column of #3 letters imprinted on said substrate, said #3 letters being subcategories of said #2 letters, said another column being one letter wide, said #3 letters being chosen from the set of letters comprising said #3 letter categories, said #3 letters of said chart being visible when said book is closed and visually alignable to the length edges of the pages of said book, wherein said chart is only two letters wide;

third means to designate #3 letters, corresponding to at least some of the #3 letter categories, said third means being located on or near said length page edges and being visible when said book is closed, at least some of said third means being structurally coordinated with a #3 letter in said chart such that each said third means so coordinated is located generally across from its corresponding #3 letter in said chart, and such that said third means is located on a page within the pages of a preselected #1 letter category and within the pages of a #2 letter category wherein the #3 letter category corresponding to the third means is to be found;

wherein there is more than one said third means structurally coordinated with at least one of said #3 letters in said chart, the more than one said third means structurally coordinated with a single #3 letter in said chart appearing in separate preselected #1 letter categories;

whereby when the book is opened to the first page of a preselected #1 letter category, said index indicates where to open said book to find a #2 letter category and a #3 letter category within the pages comprising the preselected #1 letter category.

45. The dictionary index in claim 43 wherein a #2 letter in said chart also refers to a #1 letter category, and approximately across from said #2 letter in said chart there is a #1 letter mark on the length page edge of at least the first page of the #1 letter category that said #2 letter in said chart also refers to.

46. The dictionary index in claim 43 also comprising:

said chart also comprising in said column #3 letters imprinted on said substrate, said #3 letters being subcategories of said #2 letters, said #3 letters being beneath said #2 letters in said column, said #3 letters being chosen from the set of letters comprising said #3 letter categories, said #3 letters of said chart being visible when said book is closed and visually alignable to the length edges of the pages of said book, wherein said column is only one letter wide;

third means to designate #3 letters, corresponding to at least some of the #3 letter categories, said third means being located on or near said length page edges and being visible when said book is closed, at least some of said third means being structurally coordinated with a #3 letter in said chart such that each said third means so coordinated is located generally across from its corresponding #3 letter in said chart, and such that said third means is located on a page within the pages of a preselected #1 letter category and within the pages of a #2 letter category wherein the #3 letter category corresponding to the third means is to be found;

wherein there is more than one said third means structurally coordinated with at least one of said #3 letters in said chart, the more than one said third means structurally coordinated with a single #3 letter in said chart appearing in separate preselected #1 letter categories;

whereby when the book is opened to the first page of a preselected #1 letter category, said index indicates where to open said book to find a #2 letter category and a #3 letter category within the pages comprising the preselected #1 letter category.

47. A dictionary index comprising:

a book comprising a plurality of pages and a back cover, said pages having exposed top, bottom, and side edges and the contents of said book comprising an alphabetical listing of words;

the pages of said book being divided into a predetermined number of #1 letter categories with the pages comprising each #1 letter category being further divided into a plurality of #2 letter categories the set of letters defining the #1 letter categories and the set of letters defining the #2 letter categories being identical and in alphabetical order;

a chart comprising a substrate with a vertically oriented column of letters imprinted thereon, said letters being arranged in alphabetic order from the top of said substrate to the bottom of said substrate, said letters being identical to the set of letters comprising said #1 and #2 letter categories, said substrate being affixed to said cover so as to be visible when said book is closed;

a plurality of designation marks associated with and generally across from said column of letters on said chart, said designation marks being imprinted on selected ones of said pages near the exposed side edges of same so as to be visible when said book is closed, said designation marks being divided into at least two groups defining #1 letter designation marks and #2 letter designation marks, the #1 letter designation marks differing visibly from the #2 letter designation marks, a #1 letter designation mark being imprinted on the first page of sid book which contains a word with the same #1 letter as the first letter in said set of #1 letter categories, a #1 letter designation mark being imprinted on the next page of said book which contains a word with the same #1 letter as the second letter in said set, a #1 letter designation mark being imprinted on each remaining page of said book which is the first page upon which appears the remaining #1 letters in said set, each said #1 letter designation mark being located along the edge of said page so as to be generally across from its associated letter on said chart, the set of pages between each page containing a #1 letter designation mark defining a #1 letter category, each said set of pages being subdivided into a plurality of #2 letter categories with a #2 letter designation mark being imprinted on the first page within each said set of pages upon which a word appears with the same #2 letter as the first letter in said set of #2 letter categories. a #2 letter designation mark being imprinted on each remaining page of each said set of pages upon which first appears a word with the remaining #2 letters in said set of #2 letter categories, each #2 letter designation mark being located on its associated page so as to appear generally across from its associated letter on said chart, whereby a #1 letter designation mark is imprinted on selected pages of said book to correspond with each letter in said set of #1 letter categories and a #2 letter designation mark is imprinted on selected pages within each said set of pages corresponding to each letter in said set of #2 letter categories, such that the same letter in said column of letters on said chart serves as an indicator for both the #1 letter category and the #2 letter category associated with said letter.

* * * * *

UNITED STATES PATENT AND TRADEMARK OFFICE

CERTIFICATE OF CORRECTION

PATENT NO. : 4,813,710

DATED : March 21, 1989

INVENTOR(S) : Alexander Weilgart

It is certified that error appears in the above-identified patent and that said Letters Patent is hereby corrected as shown below:

Column 5, line 7, change "silver" to -- sliver --.
Column 5, line 53, change "the" to -- The --.
Column 5, line 59, change "teh" to -- the --.
Column 5, line 65, change the number "1" after that letter n to -- 17 --.
Column 7, line 22, change "diagonal" to -- Diagonal --.
Column 7, line 27, change "diagonl" to -- diagonal --.
Column 7, line 53, change "2#2" to -- #2 --, therein deleting the first 2.
Column 8, line 28, change "alre" to -- already presented. --.
Column 8, line 48, put the long hyphen in front of "along", that omitted hyphen intended to be the counterpart of the hyphen in line 49 below.
Column 11, line 14, change "these" to -- These --.
Column 12, line 60, change "glude" to -- glued --.
Column 14, line 30, put a space between the two words "the" and "length".
Column 14, line 66, change "beings" to -- begins --.
Column 15, line 9, change "pserson" to -- person --.
Column 15, line 43, change the period after capital P to a comma.
Column 15, line 54, change "where" to -- there --.
Column 16, line 52, change "or" to -- of --.
Column 18, line 26, change "lest" to -- less --.
Column 18, line 36, change "teh" to -- the --.
Column 22, line 34, change "silver" to -- sliver --.
Column 22, line 36, change "silver" to -- sliver --.
Column 22, line 60, between the words "to" and "diagonal" put -- no --.
Column 25, line 32, change "abbreciation" to -- abbreviation --.
Column 26, line 2, change "we" to -- is --.
Column 27, line 13, change "then" to -- Then --.
Column 27, line 37, change "positoin" to -- position --.
Column 27, line 51, change "having" to -- have --.
Column 28, line 49, change "delted" to -- deleted --.
Column 30, line 44, change the first "#2" to -- #1 --.
Column 31, line 1, change "arrengement" to -- arrangement --.
Column 31, lines 12 and 13, put that heading in capitals on a separate line from line 12 from the previous paragraph.
Column 31, line 66, change the second "#2" in that line to -- #3 --.
Column 31, line 68, change "h" to -- he opens --.
Column 33, line 19, change "sid" to -- said --.
Column 33, line 36, change "charge" to -- chart --.

UNITED STATES PATENT AND TRADEMARK OFFICE

CERTIFICATE OF CORRECTION

PATENT NO. : 4,813,710

DATED : March 21, 1989

INVENTOR(S) : Alexander Weilgart

It is certified that error appears in the above-identified patent and that said Letters Patent is hereby corrected as shown below:

Column 34, lines 15 and 16, those lines should not be part of a separate paragraph, and claim 13 should be one paragraph.

Column 36, line 14, change "the" to -- The --.
Column 36, line 46, change "silver" to -- sliver --.
Column 36, line 48, change "silver" to -- sliver --.
Column 37, line 12, change "delted" to -- deleted --.
Column 37, line 19, put a space between the words "addition" and "of".
Column 37, line 24, change "sid" to -- said --.
Column 37, line 63, change "coordianted" to -- coordinated --.
Column 40, line 8, change "sid" to -- said --.
Column 40, line 28, after the word "categories" change that period to a comma.

Signed and Sealed this

Eleventh Day of June, 1991

*Attest:*

*Attesting Officer*

HARRY F. MANBECK, JR.

*Commissioner of Patents and Trademarks*